US005794472A

United States Patent [19]

Kester et al.

[11] Patent Number: 5,794,472

[45] Date of Patent: Aug. 18, 1998

[54] DISCONNECTING DRIVE MECHANISM FOR CYLINDRICAL LOCKSET

[75] Inventors: Steven A. Kester, Noblesville; Scott A. Gilbertson, Indianapolis; John W. McIntire, Anderson; Ralph P. Palmer, Indianapolis, all of Ind.

[73] Assignee: Best Lock Corporation, Indianapolis, Ind.

[21] Appl. No.: 432,528

[22] Filed: May 1, 1995

[51] Int. Cl.[6] ..... E05B 13/10

[52] U.S. Cl. ..... 70/472; 70/149; 70/223; 70/224; 70/422; 292/DIG. 27

[58] Field of Search ..... 70/422, DIG. 42, 70/472, 224, 149, 473–480, 483–485, 217, 218, 221–223; 292/DIG. 27

[56] References Cited

U.S. PATENT DOCUMENTS

| | | | |
|---|---|---|---|
| 36,685 | 11/1971 | Sargent | 70/422 X |
| 1,516,152 | 11/1924 | Dumont . | |
| 1,565,754 | 12/1925 | Orth . | |
| 1,611,940 | 12/1926 | Ohmer . | |
| 1,871,169 | 8/1932 | Floraday . | |
| 1,897,523 | 2/1933 | Marple . | |
| 1,899,997 | 3/1933 | Sullivan . | |
| 2,642,735 | 6/1953 | Quigley | 70/380 |
| 2,657,567 | 11/1953 | Young | 70/224 |
| 2,738,666 | 3/1956 | Tornoe | 70/432 |
| 2,998,274 | 8/1961 | Russell | 292/169.17 |
| 3,048,996 | 8/1962 | Russell et al. | 292/336.3 |
| 3,079,189 | 2/1963 | Russell et al. | 292/336.3 |
| 3,183,740 | 5/1965 | Legge | 292/336.3 |
| 3,442,102 | 5/1969 | Butts | 70/1.5 |
| 3,566,633 | 3/1971 | Borck | 70/252 |
| 3,566,634 | 3/1971 | Borck | 70/252 |
| 3,621,685 | 11/1971 | Sargent | 70/422 X |
| 3,922,896 | 12/1975 | Kagoura | 70/223 |
| 3,955,387 | 5/1976 | Best et al. | 70/224 |
| 4,195,502 | 4/1980 | Best et al. | 70/224 |
| 4,312,201 | 1/1982 | Roos | 70/422 |
| 4,370,875 | 2/1983 | Piiroinen | 70/422 |
| 4,394,821 | 7/1983 | Best et al. | 70/422 |
| 4,424,691 | 1/1984 | Foshee | 70/224 |
| 4,437,695 | 3/1984 | Foshee et al. | 267/164 |
| 4,550,581 | 11/1985 | Best et al. | 70/422 |
| 4,604,879 | 8/1986 | Neary et al. | 70/224 |
| 4,655,059 | 4/1987 | Best et al. | 70/224 |
| 4,671,089 | 6/1987 | Fleming et al. | 70/452 |

(List continued on next page.)

FOREIGN PATENT DOCUMENTS

| | | |
|---|---|---|
| 151081 | 8/1985 | European Pat. Off. . |
| 42529 | 8/1933 | France . |
| 47581 | 2/1930 | Norway . |
| 49311 | 9/1931 | Norway . |

*Primary Examiner*—Lloyd A. Gall
*Attorney, Agent, or Firm*—Barnes & Thornburg

[57] ABSTRACT

A cylindrical lock is provided for use in a door containing a latch bolt supported for movement between an extended door-latching position and a retracted door-unlatching position. The door further includes a latch bolt retractor assembly connected to the latch bolt and movable relative to the door to move the latch bolt between the extended door-latching position and the retracted door-unlatching position. The cylindrical lock includes a hub, a door handle, a spindle, and a locking lug. The hub is adapted to mount in a fixed position on the door and is formed to include a first hub slot and a second hub slot communicating with the first hub slot. The door handle is mounted for rotation relative the hub. The spindle is coupled to the door handle and is formed to include a spindle slot defined by spaced-apart driving surfaces. The locking lug is movable between a first position fixing the spindle and hub together and a second position uncoupling the spindle and hub. In the first position, the locking lug is positioned to lie in the first hub slot formed in the hub and the spindle slot formed in the spindle. In the second position, the locking lug is positioned to lie in the spindle slot formed in the spindle and the second hub slot formed in the hub. The locking lug is formed to include a frangible section through which the locking lug shears if overtorqued when in the first position.

14 Claims, 13 Drawing Sheets

OTHER PUBLICATIONS

| | | | |
|---|---|---|---|
| 4,679,420 | 7/1987 | Yang | 70/422 |
| 4,773,240 | 9/1988 | Foshee | 70/222 |
| 4,869,083 | 9/1989 | Demarseilles et al. | 70/224 |
| 4,920,773 | 5/1990 | Surko, Jr. | 70/224 |
| 4,941,334 | 7/1990 | Fish et al. | 70/214 |
| 4,998,760 | 3/1991 | Nixon et al. | 292/347 |
| 5,010,755 | 4/1991 | Best | 70/422 |
| 5,040,652 | 8/1991 | Fish et al. | 192/56 R |
| 5,116,170 | 5/1992 | Palmer et al. | 408/72 B |
| 5,149,155 | 9/1992 | Caeti et al. | 292/336.3 |

10a
11a

DISCONNECTING DRIVE MECHANISM FOR CYLINDRICAL LOCKSET

BACKGROUND AND SUMMARY OF THE INVENTION

The present invention relates to a lockset for operating a latch bolt retractor assembly mounted in a door, and particularly to a cylindrical lockset having a door handle and a spring-biased door handle return assembly mounted inside the door and adjacent to the latch bolt retractor assembly. More particularly, the present invention relates to a door-mounted cylindrical lockset having a latch bolt retraction-delay drive mechanism interconnecting the door handle and the latch bolt retractor assembly that is disengaged when the cylindrical lockset is in a locked position to enhance the ability of the cylindrical lockset to prevent access during attack by a person.

Cylindrical locksets are well known. See, for example, U.S. Pat. No. 3,955,387 to Best et al.; U.S. Pat. Nos. 4,424,691 and 4,437,695 to Foshee; and U.S. Pat. No. 4,920,773 to Surko, Jr. A cylindrical lockset connects a door handle to a retractable latch bolt mounted in a door so that the door handle can be turned to retract the latch bolt and unlatch the door. Typically, a cylindrical lockset is mounted in a lockset-receiving aperture provided in a door.

The latch bolt is mounted for sliding movement in a horizontal passage formed in the door. The horizontal passage has a first opening at one end in a vertical edge of the door and a second opening at the other end communicating with the lockset-receiving aperture formed in the door. The latch bolt is normally biased by a spring to an extended or projected position latching the door. The latch bolt is moved against the spring to a retracted position inside the horizontal passage by the cylindrical lockset once the door handle is turned properly by a user.

Each cylindrical lockset includes various mechanical linkages and locking mechanisms mounted inside the lockset-receiving aperture formed in the door and used to control operation of a latch bolt retractor coupled to the latch bolt. An outer portion of the cylindrical lockset carries an outside door handle (e.g., knob or lever arm) and an inner portion of the cylindrical lockset carries an inside door handle.

To open a door, a user can turn either the inside or outside door handle to operate the mechanical linkage mounted inside the cylindrical lockset. This action enables a user to retract a spring-biased latch bolt mounted in the horizontal passage and connected to the cylindrical lockset from an extended position extending beyond the vertical edge of the door and engaging a cavity formed in a door jamb to a retracted position inside the door. The user is now free to swing the door on its hinges from a closed position to an opened position.

Conventional cylindrical locksets typically include a one-piece sleeve for retracting the latch bolt in response to turning the door handle. For example, U.S. Pat. No. 4,424,691 to Foshee relates to a pull-resistant cylinder lock and discloses a knob sleeve having an outer end including means for engaging and rotating with the door handle and an inner end including cam ears for operating a latch bolt retractor assembly. The cam ears operate the latch bolt retractor assembly to retract the latch bolt every time the door handle is rotated properly.

If a person places excessive torque on a locked cylindrical lockset, one or more components within the lockset can break to permit the person to rotate the door handle and attached one-piece sleeve. As a result, the cam ears on the one-piece sleeve turn to operate the latch bolt retractor assembly, thereby retracting the latch bolt to allow the door to open.

People have also developed other techniques for attacking locked cylindrical locksets. Recently, people have been attacking conventional cylindrical locksets using a two-step "yanking" technique. Using this two-step technique, a skilled person first strikes downwardly or upwardly on the lever arm on a door handle with a hand or a blunt instrument and then immediately jerks the lever arm in the direction in which the door opens. Each of the forces resulting from the initial striking motion down on the lever arm and the subsequent jerking motion on the lever arm can be transmitted through the components in the cylindrical lockset to cause the latch bolt to move to a retracted position unlatching the door. It appears that a skilled person can develop a pattern of continuously striking and jerking on the lever arm of an outside door handle using a suitable rhythm that can, in some cases, eventually cause the latch bolt to retract enough to permit the person to unlatch and open the door without authorization. This yanking technique has been used in recent times by skilled people to gain unauthorized access.

It is more common in the last several years, especially in public buildings, to use lever handles instead of door knobs on doors. The lever handle, when not being used, generally lies in a horizontal home position parallel to the floor. When the lever handle is rotated away from the horizontal home position by a user to operate the mechanical linkage and is then released by the user, a lever handle return spring mounted in the latch bolt retractor assembly biases the lever handle back to its horizontal home position.

A radially outwardly extending lever handle typically is heavier than a door knob and is offset from the axis of rotation of the cylindrical lockset to apply a greater load to the retractor assembly spring than would otherwise be applied by a door knob. It is known to provide an additional spring in the lockset for assisting the retractor assembly spring in returning the lever handle to its horizontal home position. See, for example, U.S. Pat. No. 4,920,773 to Surko, Jr.

Conventional cylindrical locksets further include relatively thin stamped metal pieces surrounding the mechanical linkage and door handle return assembly. The thin stamped metal pieces may fail under an attack by a person and expose the internal components of the lockset to damage during the attack.

What is needed is an improved cylindrical lockset that has a drive mechanism having a more secure configuration to retain the lockset in a locked position when the drive mechanism is subjected to excessive torque or yanking during an attack. Further, consumers would appreciate a lever handle return assembly having increased spring force for better feel and minimum lever handle droop. An improved cylindrical lockset configured to include a sturdy protective hub or housing for protecting the internal components of the lockset (i.e., the mechanical linkage and the door handle return assembly) from damage during an attack on the lockset would avoid shortcomings of many conventional cylindrical locksets.

According to the present invention, an improved cylindrical lockset includes a rotatable door handle for retracting a latch bolt away from a doorjamb to allow a door to open when the lockset is in the unlocked position. The cylindrical lockset also includes a two-piece retractor operator assembly that connects the door handle to a latch bolt retractor assembly that is movable to retract the latch bolt.

In preferred embodiments, the two-piece retractor operator assembly is designed to help the improved cylindrical lockset remain in a locked position during certain types of attacks on the lockset by a person. The retractor operator assembly includes an outer spindle coupled for rotation with the door handle and a retractor control member situated to lie inside the outer spindle and formed to include ear-like cams for operating the latch bolt retractor assembly. The latch bolt retractor assembly is operated only when the retractor control member and its cams rotate in response to rotation of the door handle and the outer spindle when the lockset is in the unlocked position. The retractor control member is configured to rotate only at certain times. For example, the retractor control member rotates with the spindle to operate the latch bolt retractor assembly when the lockset is in the unlocked position. In addition, the retractor control member can also rotate to operate the latch bolt retractor assembly in response to rotation of an operating key in the lockset by a user.

People often try to damage cylindrical locksets intentionally in an effort to open a locked door. The person typically attacks the locked cylindrical lockset by applying excessive torque to the door handle or yanking on the door handle. These attacks are usually designed to break one or more of the components in the cylindrical lockset so the lockset is unable to remain in a locked position. Once the cylindrical lockset is forcibly unlocked, the person can use the door handle to open the door.

When the lockset is in the locked position, the door handle and spindle are prevented from rotating by a locking lug included in the lockset. If the lockset is overtorqued by a would be intruder during an attack causing the locking lug to shear, the door handle and outer spindle will rotate, but they will rotate through a predetermined latch bolt retraction-delay angle before the outer spindle is moved to a position where it can begin to rotate the retractor control member connected to the latch bolt retractor assembly. Thus, operation of the latch bolt retractor assembly will have been "delayed" during an attack on the lockset because the door handle must be rotated through the latch bolt retraction-delay angle before the retractor control member moves to begin retracting the latch bolt. The latch bolt never fully retracts to allow the door to open because the door handle is positioned to engage the door frame at some point during the attack, thereby preventing further rotation of the door handle before the latch bolt is fully retracted. This latch bolt retraction-delay angle between the door handle and latch bolt delays latch bolt retraction and prevents full latch bolt retraction during an "overtorquing" attack and therefore provides a more secure configuration.

The improved cylindrical lockset in accordance with the present invention includes a "supplemental" door handle return assembly to return the lever arm to its horizontal home position. The door handle includes a lever arm that lies in a horizontal home position parallel to the floor when not in use (i.e., being rotated). When the door handle is rotated to retract the latch bolt, the door handle is moved away from its horizontal home position. The door handle return assembly includes a torsion spring coupled to the outer spindle through a spring drive plate. As the lever arm rotates, the torsion spring compresses. When the lever arm is released, the torsion spring expands and rotates the outer spindle and lever arm back to the horizontal home position.

The improved cylindrical lockset in accordance with the present invention further includes a thick outer hub surrounding the two-piece retractor operator assembly, the locking-unlocking assembly, and the door handle return assembly. The outer hub is configured to mount in the door and the outer spindle is mounted to extend into the outer hub for rotation relative to the outer hub. The retractor control member is positioned inside the outer spindle and the locking-unlocking assembly is situated inside the retractor control member.

The thick outer hub includes a thick body portion and a hooded portion extending axially into the door and away from the thick body portion. The thick body portion of the hub surrounds the two-piece retractor operator assembly and the locking-unlocking assembly. The door handle return assembly is situated at the axially inward end of retractor operator assembly within the hooded portion of the outer hub.

The outer spindle and retractor control member are formed to include axial slots which define a channel. The improved cylindrical lockset in accordance with the present invention also includes a locking lug movable within the channel between a locked position and an unlocked position. The locking-unlocking assembly operates to move the locking lug between the locked and unlocked positions.

In the unlocked position, the locking lug is positioned within the channel in a circumferentially extending slot formed in the outer hub so that as the door handle rotates the outer spindle, the outer spindle rotates the locking lug through the circumferentially extending slot in the outer hub. The locking lug transmits the rotation of the outer spindle to the retractor control member. The retractor control member includes the cams which operate the latch bolt retractor assembly to retract the latch bolt.

In the locked position, the locking lug is positioned within the channel in an axially extending slot formed in the outer hub. This position of the locking lug prevents the outer spindle and the door handle from rotating, thereby preventing rotation of the retractor control member to operate the latch bolt retractor assembly.

A person may attempt to breach the security of the lockset by (1) exerting excessive torque on the lockset or (2) using the two-step yanking technique. The improved cylindrical lockset provides a more secure configuration to increase the security of the lockset during such attacks by a person.

If the person overtorques the cylindrical lockset, the locking lug will snap and shear along a predetermined shear line. After the locking lug snaps and shears, the door handle and spindle will rotate because the lockset is no longer retained in its locked position by the locking lug. The retractor control member is formed to include a circumferentially extending slot so that as the attached portion of the sheared locking lug is rotated by the outer spindle and door handle, the attached portion of the locking lug will not engage and rotate the retractor control member (to operate the latch bolt retractor assembly) until after the door handle, outer spindle, and attached portion of the sheared locking lug have travelled through the predetermined latch bolt retraction-delay angle. After travelling through the latch bolt retraction-delay angle, the locking lug will engage and rotate the retractor control member causing the latch bolt to begin retracting into the door. However, the latch bolt will not be able to retract fully to allow the door to be opened because the door handle is able to engage the door frame. Such engagement of the door handle against the door frame prevents further rotation of the door handle which prevents movement of the latch bolt to a fully retracted position.

If, using the other technique, a person "yanks" on the door handle, the door handle and outer spindle will rotate but the latch bolt will not retract. In contrast to the conventional cylindrical lockset, the improved cylindrical lockset does not have a one-piece sleeve interconnecting the door handle and the latch retractor assembly. Instead, the improved cylindrical lockset has a two-piece retractor operator assembly including an outer spindle connected to the door handle and a separate retractor control member having cams for operating the latch bolt retractor assembly. When the lockset is locked, the outer spindle and the retractor control member are disengaged so that rotation of the outer spindle during a yanking attack is unlikely to cause the separate retractor control member to rotate and operate the latch bolt retractor assembly. Thus, the absence of cams on the outer spindle and the disengagement of the retractor control member from the outer spindle when the lockset is in the locked position prevent the "yanking" technique from working to retract the latch bolt during an attack on the lockset.

Additional objects, features, and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which:

FIG. 8 is an enlarged, exploded, perspective view of a lock core and throw member and the retractor control member, with portions of the retractor control member broken away, when the locking lug is in its unlocked position, showing the orientation of a lost-motion drive member in the retractor control member, the locking-control bushing inside the lost-motion drive member, the locking lug, and the drive pin projecting in a radially outward direction from the locking-control bushing through drive pin-receiving slots formed in the lost-motion drive member and retractor control member;

FIG. 9 is a view similar to FIG. 8, with portions of the retractor control member broken away, showing a key after it has been inserted into the lock core and turned in a counterclockwise direction to rotate the throw member to cause the drive pin to move diagonally along a drive pin ramp formed along one edge of the triangular drive pin-receiving slot, thereby moving the locking-control bushing and the locking lug inside the retractor control member in an axially outward direction toward a locked position.

FIG. 10 is a view similar to FIGS. 8 and 9 showing sufficient rotation of the lost-motion drive member inside the retractor control member in response to further counterclockwise rotation of the throw member to cause the drive pin to come to rest in a locking notch formed in the axially outer end of a drive pin-receiving slot formed in the lost-motion drive member, thereby moving the locking-control bushing and the locking lug inside the retractor control member in an axially outward direction to the locked position;

FIG. 10*a* is a transverse sectional view taken along lines 10*a*—10*a* of FIG. 10 showing the lost-motion drive member having rotated the drive pin into the locking notch formed in the axially outer end of the drive pin-receiving slot formed in the lost-motion drive member;

FIG. 11 is a view similar to FIGS. 8–10 (but taken from another perspective on the opposite side of the lock core) showing the initial stages of a lockset-unlocking sequence wherein the operating key rotates in a clockwise direction to move the lost-motion drive member and drive pin across a bottom edge along the triangular drive pin-receiving slot while the drive pin remains in the locking notch of the L-shaped drive pin-receiving slot formed in the lost-motion drive member;

FIG. 12 is a view similar to FIG. 11 showing further rotation of the operating key in a clockwise direction causing the right edge of the triangular drive pin-receiving slot formed in the retractor control member to force the drive pin out of the locking notch in the drive pin-receiving slot formed in the lost-motion drive member and into a straight portion of the drive pin-receiving slot formed in the lost-motion drive member so that the drive pin moves axially inward through the straight portion due to the bias of a spring situated within the lost-motion drive member, thereby moving the locking-control bushing and its locking lug to an unlocked position;

FIG. 12*a* is a transverse sectional view taken along lines 12*a*—12*a* of FIG. 12 showing the drive pin in the unlocked position as in FIG. 9*a* ;

DETAILED DESCRIPTION OF THE DRAWINGS

Figure 1:
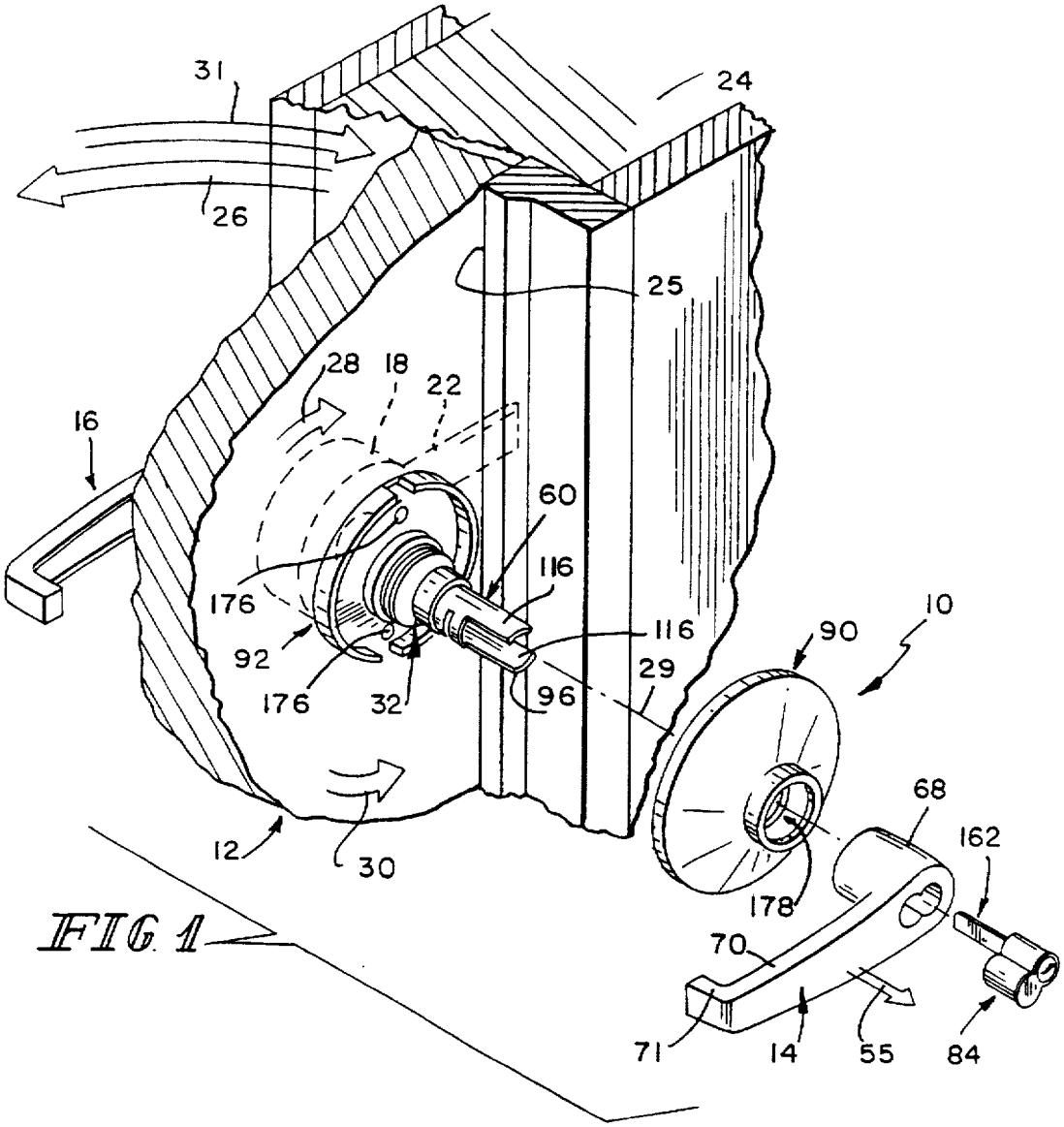
FIG. 1 is an exploded perspective view of a cylindrical lockset in accordance with the present invention showing the lockset in a partly assembled condition on a closed door and showing a latch bolt (in phantom) securing the closed door to a door frame.
Figure 4:
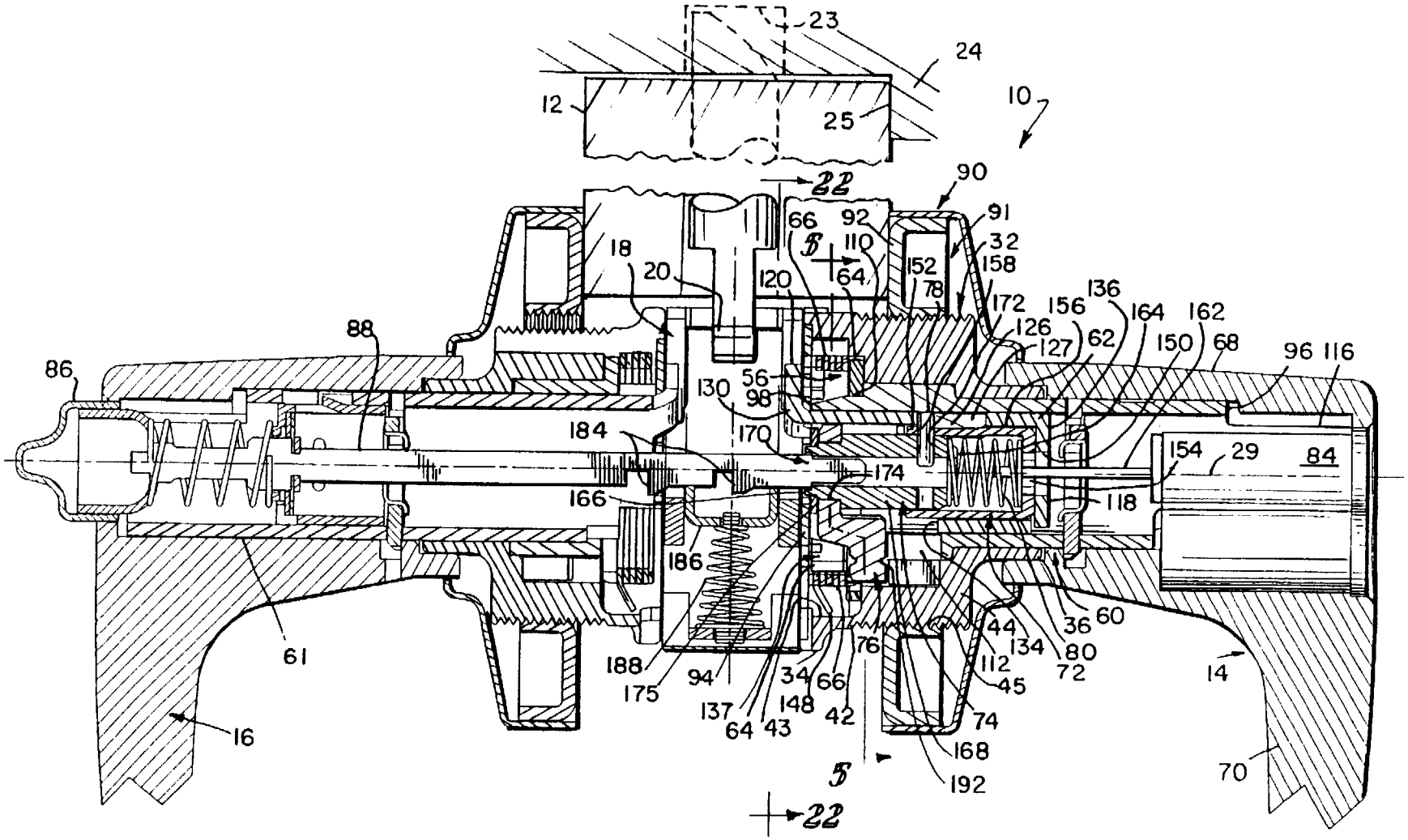
FIG. 4 is an enlarged longitudinal sectional view of the cylindrical lockset of FIG. 1 in an unlocked condition showing a spring-biased latch bolt in its door-latching position, a centrally located latch bolt retractor assembly, a left-side inner door handle, a right-side outer door handle engaging an outer spindle mounted for rotation in a threaded outer hub, a retractor control member received in the outer spindle and engaging the latch bolt retractor assembly, and a locking lug mounted on a locking control bushing received in the retractor control member and situated in its unlocked position to link the retractor control member to the outer spindle so that the retractor control member rotates in response to rotation of the outer spindle by the outer door handle to operate the latch bolt retractor assembly to unlatch the door.

A lever-handled cylindrical lockset 10 is mounted in a door 12 as shown in FIGS. 1 and 4 and is used to latch and lock the door 12. The cylindrical lockset 10 includes a disconnecting drive mechanism that is provided to enhance the security of the lockset 10 during an attack by a person and is described herein and illustrated in the drawings. People have been known to attack cylindrical locksets using "overtorquing" and/or "yanking" techniques.

The lockset 10 is operable by means of either an outer door handle 14 or an inner door handle 16 to operate a centrally located latch bolt retractor assembly 18. The latch bolt retractor assembly 18 is mounted in the door 12 and is connected to the tail piece 20 of a spring-biased latch bolt 22. The latch bolt retractor assembly 18 can be operated to retract the latch bolt 22 from its extended or projected position engaging door frame 24 to a retracted position lying inside the door 12 and disengaging door frame 24.

As shown in FIG. 1, cylindrical lockset 10 also includes a threaded outer hub 32, a rotatable outer spindle 60 arranged to extend through outer hub 32 and carry outer door handle 14, an outer rose liner 92 mounted on door 12 to surround outer hub 32, and a rose cover 90 coupled to rose liner 92. A key-removable figure-8-shaped lock core 84 is mountable in an aperture formed in the outer door handle 14. The outer spindle 60 passes through central apertures formed in outer hub 32, rose liner 92, and rose cover 90. As shown in FIG. 4, the outer hub 32, rose liner 92, and rose cover 90 cooperate to define an interior region 91 therebetween that is empty.

As shown in FIG. 1, when the door 12 is in a closed position, the latch bolt 22 is spring-biased to extend outwardly into a door frame 24 to prevent the door 12 from opening. More specifically, the latch bolt 22 extends into a cavity 23 formed in doorjamb 25 as shown in FIG. 4. Referring again to FIG. 1, to swing the door 12 in swing-open direction 26 to an opened position, either the inner door handle 16 or the outer door handle 14 can be rotated about an axis of rotation 29 in direction 28 or direction 30. For example, rotation of outer door handle 14 (when unlocked) in direction 28 or direction 30 rotates outer spindle 60 relative to the outer hub 32, rose liner 92, and rose cover 90. Rotation of outer spindle 60 operates latch bolt retractor assembly 18 to retract latch bolt 22 to a doorjamb-disengaging position inside door 12.

Figure 15:
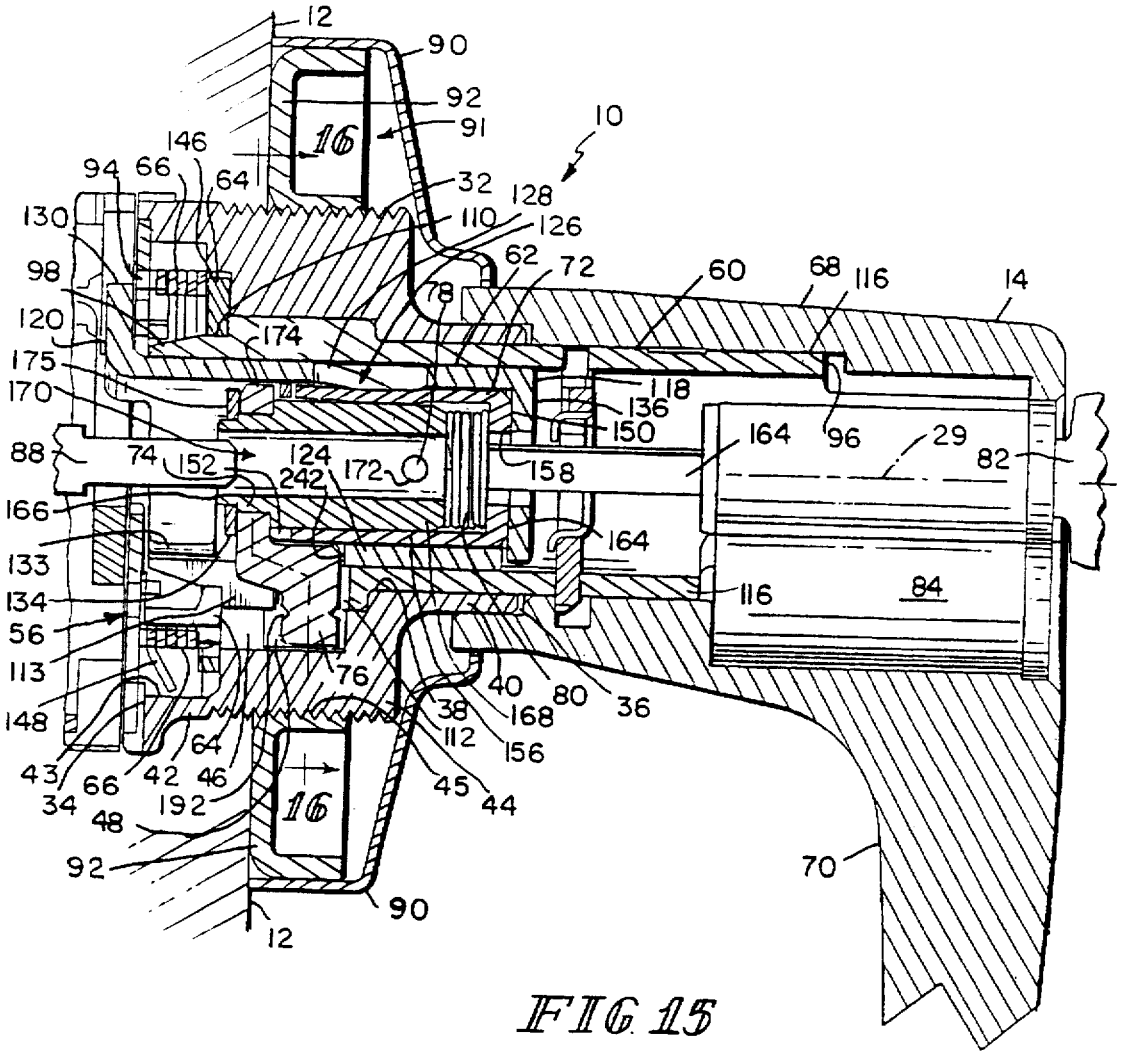
FIG. 15 is a longitudinal sectional view of an outer portion of the cylindrical lockset of FIG. 1 in the locked position showing the locking-control bushing after it has been moved inside the retractor control member to an axially outermost position to place the locking lug in the locked position linking the outer spindle to the outer hub.

After either door handle 14, 16 has rotated to operate latch bolt retractor assembly 18, a spring-loaded door handle return assembly 56 included in a portion of lockset 10 positioned in a protected location inside door 12 and away from the interior region 91 of rose assembly 90, 92 acts to return the door handle 14, 16 to its original horizontal home position. Illustratively, door handle return assembly 56 is protectively mounted in a hooded chamber 43 formed in the axially inner end 34 of the threaded outer hub 32 as shown in FIGS. 4 and 15. Later, the door 12 can be swung in swing-close direction 31 to reengage latch bolt 22 in cavity 23 to latch the door 12 in a closed position.

Figure 16:
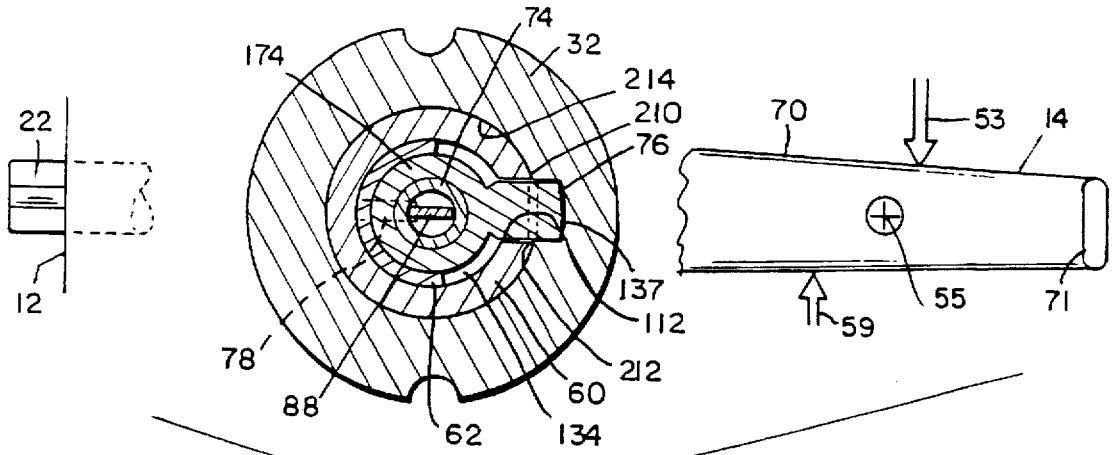
FIG. 16 is a transverse sectional view taken along lines 16—16 of FIG. 15 showing the locking lug engaging an axially extending locking lug-receiving slot formed in the outer hub to prevent rotation of the lever handle and outer spindle relative to the outer hub.
Figure 17:
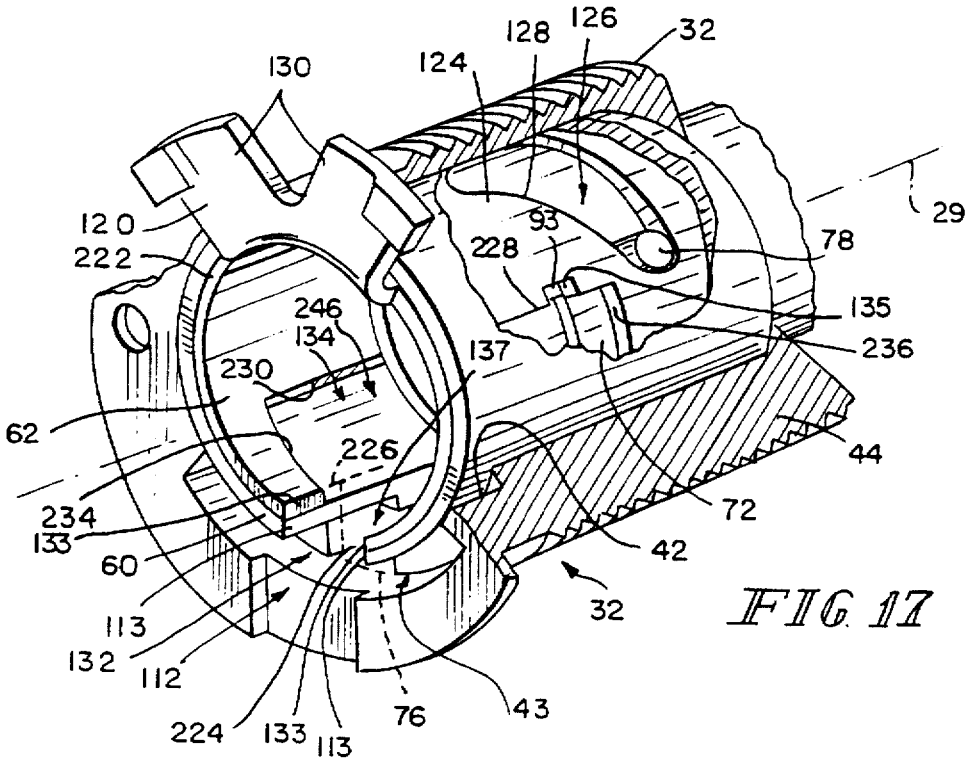
FIG. 17 is a view corresponding to FIG. 16 (after the threaded outer hub has been rotated 90° in a clockwise direction about a central axis of the cylindrical lockset), with portions of the outer hub and spindle broken away (and the locking-control bushing omitted), to show the position of the drive pin in the triangular window formed in the retractor control member when the locking lug (in phantom) is in its locked position.

Illustratively, lockset 10 is shown in an unlocked position in FIGS. 4–7 and in a locked position in FIGS. 15–17. When the lockset 10 is locked, a person is prevented from rotating the outer door handle 14 in the normal manner to operate the lockset 10 and retract latch bolt 22 so that door 12 can be opened. Importantly, the lockset 10 has a more secure configuration achieved using various internal lost-motion drive connections to make it harder for people to open a locked door by applying excessive torque to or "yanking" on the outer door handle 14.

The various components included in lockset 10 are shown in an unassembled condition in FIG. 2 and will be described in detail below. Advantageously, lockset 10 has a more secure latch bolt retraction-delay design that functions to keep a person from opening a locked door 12 even if the person applies enough torque to break or snap (i.e., shear) a locking lug 76 in lockset 10.

Figure 18:
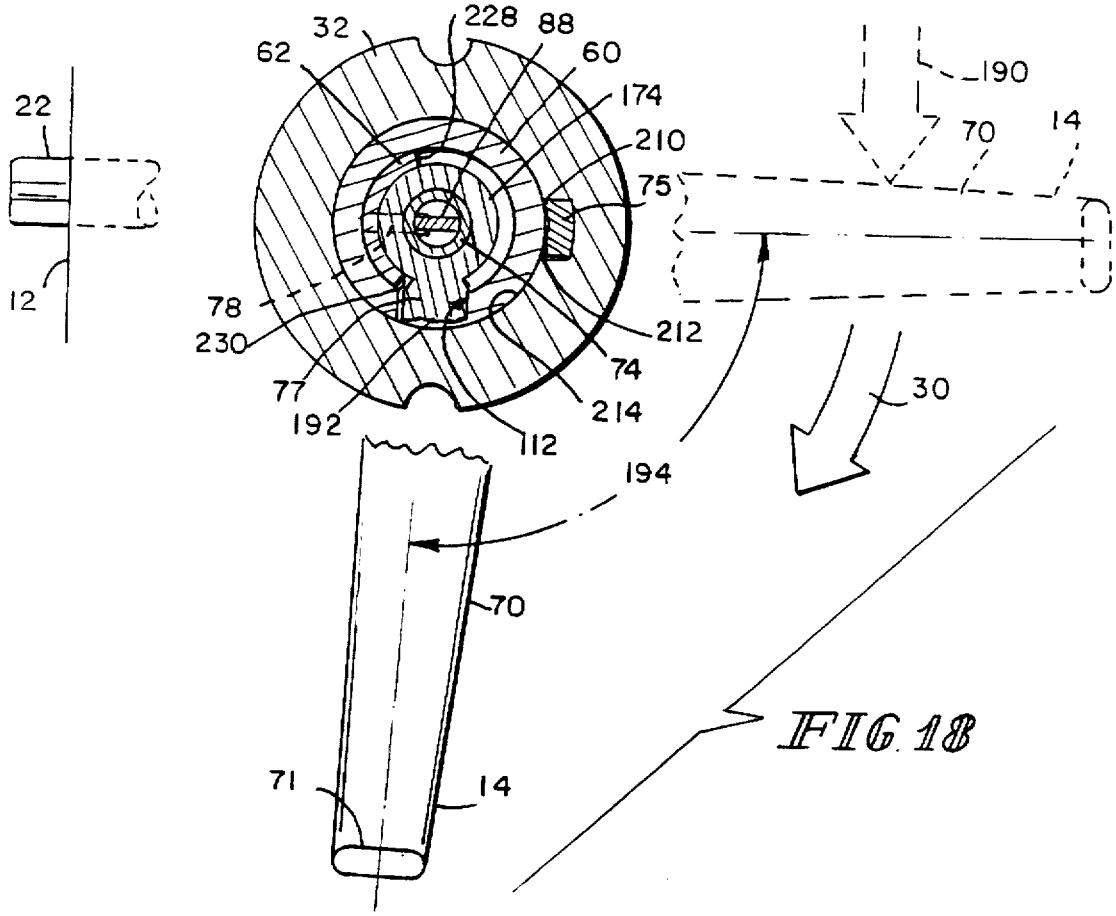
FIG. 18 is a view similar to FIG. 16 showing the locking lug after it has snapped and sheared during an overtorquing attack and showing that the lever arm and outer spindle travel about their axis of rotation through a 93° latch bolt retraction-delay angle relative to the retractor control member without engaging the retractor control member to retract the latch bolt.
Figure 20:
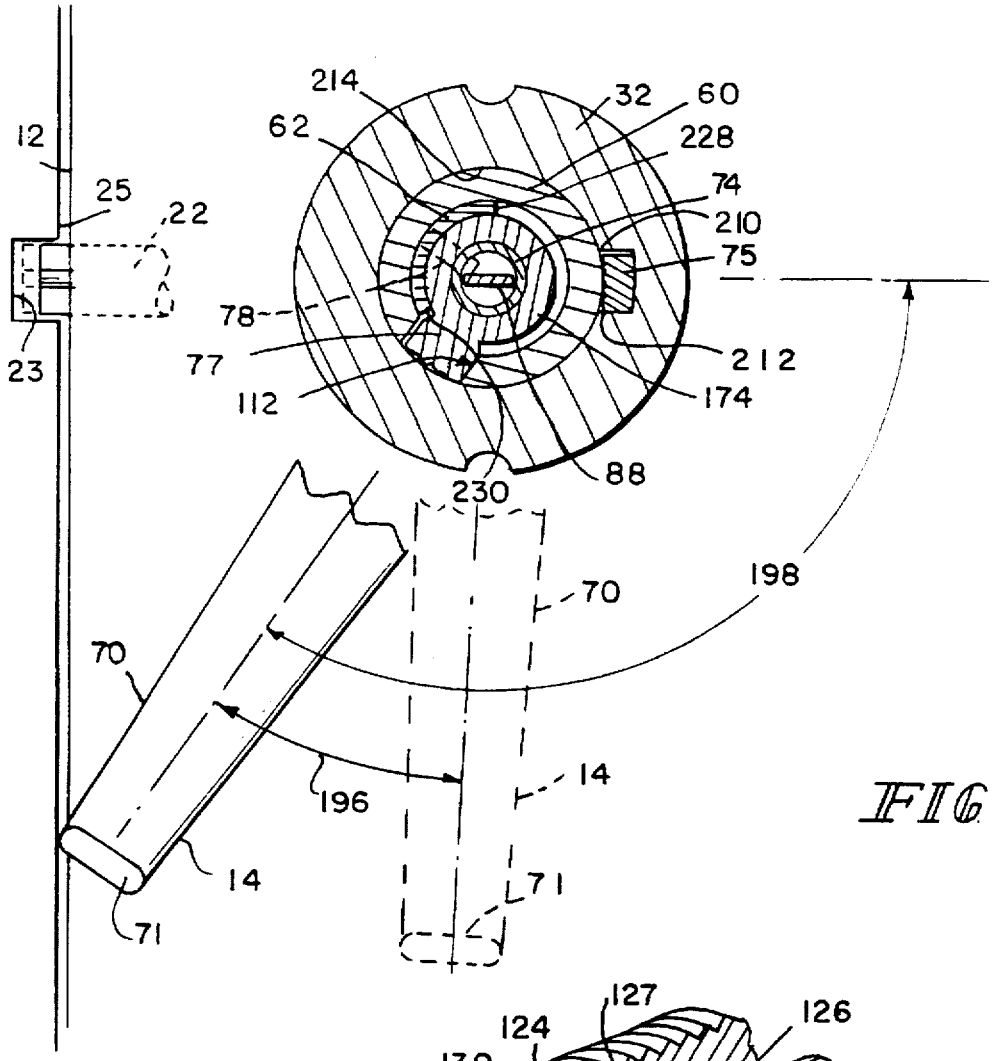
FIG. 20 is a view similar to FIG. 18 showing further rotation of the lever handle to rotate the retractor control member a small amount to cause the latch bolt retractor assembly to retract the latch bolt only partway out of a doorjamb and showing engagement of the lever handle and the door frame before the latch bolt can be fully retracted from the cavity formed in the doorjamb.

In use, in the event that a person applies excessive torque to the outer door handle 14 when the lockset 10 is in the locked position, locking lug 76 (see FIG. 4) within the lockset 10 will shear along a predetermined shear line 192 as shown in FIG. 18. Once this locking lug 76 shears, the outer door handle 14 can be rotated by the person through a controlled latch bolt retraction-delay angle of approximately 93° (as shown in FIG. 18) before it has been rotated enough to begin retracting the latch bolt 22 from the doorjamb 25. However, due to the design of lockset 10, the outer door handle 14 cannot be rotated far enough by the person to withdraw the spring-biased latch bolt 22 fully from cavity 23 in doorjamb 25 (as shown in FIG. 20) and thus the person may be unable to open door 12. This is because the outer door handle 14 is configured to engage the door frame 24 after it has been rotated through the controlled 93° latch bolt retraction-delay angle, thereby preventing further rotation of the outer door handle 14 and retraction of the latch bolt 22 to a fully retracted position disengaging the doorjamb 25.

Not only can lockset 10 withstand an "overtorquing" attack in the manner described above, it is also configured to survive a two-step "yanking" technique. The two-step yanking technique is carried out by a person by striking down in direction 53 on door handle 14 using a hand or a blunt instrument and then immediately jerking in direction 55 (the direction in which the door 12 opens) on the door handle 14 several times in an effort to move the latch bolt to a retracted position inside the door as shown in FIGS. 1 and 16. An attacker will not be able to use the yanking technique to retract latch bolt 22 because the lockset 10 includes a two-piece retractor operator assembly 54 comprising an outer spindle 60 that is separate from and movable relative to a retractor control member 62 that operates to actuate the latch bolt retractor 18. The outer spindle 60 is always coupled to the lever arm 70 for rotation therewith. The retractor control member 62 is mounted for rotation inside outer spindle 60 and includes roll back cams 130 that operate the latch bolt retractor assembly 18 when rotated by outer spindle 60.

The outer spindle 60 and the retractor control member 62 in the two-piece retractor operator assembly 54 function in the following manner to preserve the security of locked lockset 10 during an overtorquing or a yanking attack. The retractor control member 62 does not always rotate with the outer spindle 60 and thus the roll back cams 130 are not always in direct-torque-drive connection with the lever arm 70. For example, when the lockset 10 is in a locked position the outer spindle 60 cannot rotate and the retractor control member 62 is free to rotate relative to the outer spindle 60. Thus, even if a person can break locking lug 76 and cause outer spindle 60 to rotate, this rotation is still not transmitted to the retractor control member 62. When a person yanks on a locked lockset 10, the latch bolt 22 does not retract because, although the lever arm 70 and outer spindle 60 rotate a small amount, the retractor control member 62 and roll back cams 130 appended to retractor control member 62 do not rotate to actuate the latch bolt retractor assembly 18.

The above-mentioned features of the cylindrical lockset 10 cooperate to give it a more secure configuration. In addition, the lockset 10 is designed to position the internal components that supply these features in a well-guarded, protected position inside an improved thick outer hub 32 that is configured to mount on the door 12 as shown in FIGS. 1 and 4. Illustratively, this outer hub 32 is an investment cast steel part. The outer hub 32 includes an inner end 34 mounted to lie inside the door 12, an outer end 36 facing axially outwardly away from the door 12, and a central aperture 38 extending from the inner end 34 to the outer end 36. The outer hub 32 also includes a relatively thin neck 40 at its outer end 36, a hooded portion 42 at its inner end 34, and a relatively thick body 44 interconnecting the neck 40 and the hooded portion 42. The hooded portion 42 has a larger inner diameter than the relatively thick body 44. The exterior surface of thick body 44 is threaded as shown in FIGS. 2–4 and 15 to engage a threaded central aperture 45 formed in the rose liner 92.

Figure 2A:
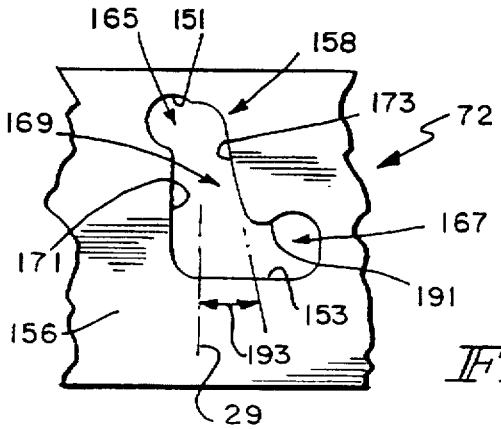
FIG. 2*a* is an enlarged view of the lost-motion drive member as it would appear if the lost-motion drive member was a flat plate showing a drive-pin receiving slot formed in the lost-motion drive member.
Figures 2, 3:
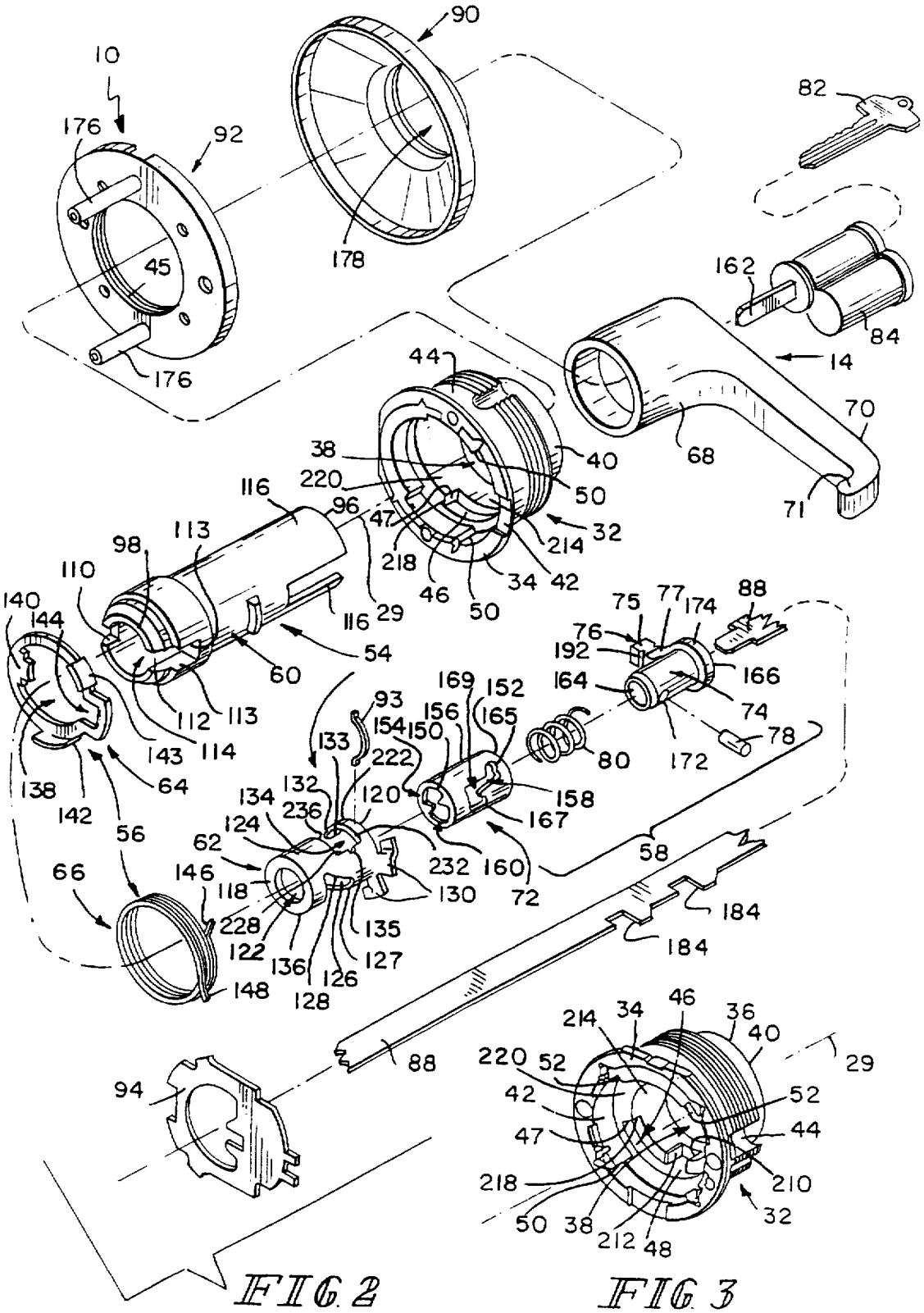
FIG. 2 is an enlarged, exploded, perspective view of the cylindrical lockset of FIG. 1 showing a key, figure-8-shaped lock core, outer door handle, threaded outer hub, elongated outer spindle, spring drive plate, torsion return spring, retractor control member including ear-like cams, "five-piece" locking-unlocking assembly including a lost-motion drive member, a locking-control bushing, a locking lug, compression spring, and a drive pin, and various other components of the cylindrical lockset.
FIG. 3 is a perspective view of the threaded outer hub shown in FIG. 2 after it has been rotated 90° in a clockwise direction about a central axis of the cylindrical lockset to show better various axial and circumferential locking lug-receiving slots formed within the inner circumference of the threaded outer hub.

As shown in FIGS. 2, 4, and 15, the outer hub 32 is arranged to surround and protect several internal components of the lockset 10. The improved thick body 44 and hooded portion 42 of the outer hub 32 are arranged and sized to increase the protection the outer hub 32 can offer to the interior components of the lockset 10 as shown in FIGS. 4 and 15. The outer hub 32 is formed to include various axial and circumferential slots and surfaces shown, for example, in FIG. 3 that cooperate with the interior components of the lockset 10 to control locking and unlocking of lockset 10. In the illustrated embodiment of the present invention, the outer hub 32 is formed to include on its inner circumference a circumferentially extending locking lug-receiving slot or circumferentially extending hub slot 46 and an axially extending locking lug-receiving slot or axially extending hub slot 48 arranged to intersect a middle portion of circumferential slot 46. Hub 32 is formed to include spaced-apart first and second edges 210, 212 defining the axially extending hub slot 48 therebetween and a continuous inner side wall 214 extending from the first edge 210 to the second edge 212 more than 300° and facing toward the axis of rotation 29 as shown, for example, in FIGS. 3, 16, 18, and 20. Hub 32 is also formed to include spaced-apart third and fourth edges 216, 218 defining the circumferentially extending hub slot 46 therebetween and a continuous inner side wall 220 extending from the third edge 216 to the fourth edge 218 more than 180° and facing toward the axis of rotation 29 as shown, for example, in FIGS. 2, 3, and 5. A locking lug travel-limiting face 47 is situated on each end of the circumferential locking lug-receiving slot 46 to provide a positive stop for the locking lug 76 to prevent damage to weaker components in the lockset 10.

Interior components of the cylindrical lockset 10 are shown in FIG. 2 prior to assembly for clarity. Each component can be assigned to one of three assemblies 54, 56, 58 included in the cylindrical lockset and illustrated in FIG. 2. The lockset 10 includes a two-piece retractor operator assembly 54 for operating latch bolt retractor assembly 18 coupled to door latch 22, a "supplemental" lever return assembly 56 for automatically returning outer lever handle 14 to its horizontal home position after it is released, and a "five-piece" locking-unlocking assembly 58 for moving a locking lug 76 between an unlocked position shown in FIG. 4 and a locked position shown in FIG. 15. Lever return assembly 56 is referred to as "supplemental" because it assists a spring situated within the latch bolt retractor assembly 18 in returning the lever handle 14 to its horizontal home position.

The two-piece retractor operator assembly 54 includes an outer spindle 60 linked at its axially outer end to rotate with the outer door handle 14 and a separate retractor control member 62 mounted for rotation inside outer spindle 60. The retractor control member 62 rotates with the outer spindle 60 only when the lockset 10 is unlocked as shown in FIGS. 4–7. When rotated by outer spindle 60, the retractor control member 62 operates the latch bolt retractor assembly 18 to retract the latch bolt 22 out of the doorjamb 25 to permit the door 12 to be opened.

Only the retractor control member 62 has the means (e.g., ear-like roll back cams 130) to operate the latch bolt retractor assembly 18 and the retractor control member 62 must be rotated by outer spindle 60 or an operating key 82 to operate the latch bolt retractor assembly 18. The configuration of the two-piece retractor operator assembly 54 which has a separate outer spindle 60 and retractor control member 62 solves the "yanking" problem because when the lockset 10 is locked, the outer spindle 60 which is coupled to the outer door handle 14 has no means to operate the latch bolt retractor assembly 18. Thus, when a person strikes down on the outer door handle 14 in direction 53 or up on the outer door handle in direction 59 and then jerks out on the outer door handle 14 in direction 55, as shown in FIG. 16, the force exerted on the outer door handle 14 is not transmitted to the roll back cams 130 to operate the latch bolt retractor assembly 18.

The lever return assembly 56 is also shown in unassembled form in FIG. 2 and is configured to be mounted in a protected position 43 deep inside threaded outer hub 32. Lever return assembly 56 includes a spring drive plate 64 that is configured to be mounted onto the outer spindle 60 and positioned within a chamber 43 formed in the hooded portion 42 of the outer hub 32. The lever return assembly 56 also includes a torsion spring 66 positioned next to spring-drive plate 64 within the hooded portion 42 of outer hub 32. The outer hub 32 includes spring finger-engaging surfaces 50 at its inner end 34 and each leg 146, 148 of torsion spring 66 engages one of the spring finger-engaging surfaces 50 formed in outer hub 32.

Figure 22:
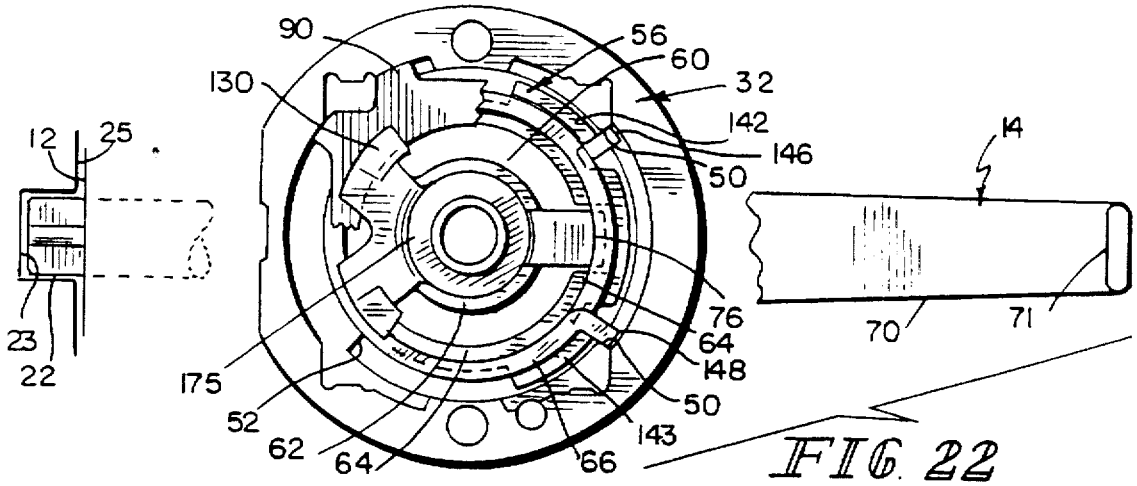
FIG. 22 is a transverse sectional view taken along line 22—22 of FIG. 4 showing a torsion spring included in a lever handle return assembly and situated within the outer hub to bias the lever handle to its horizontal home position.
Figure 23:
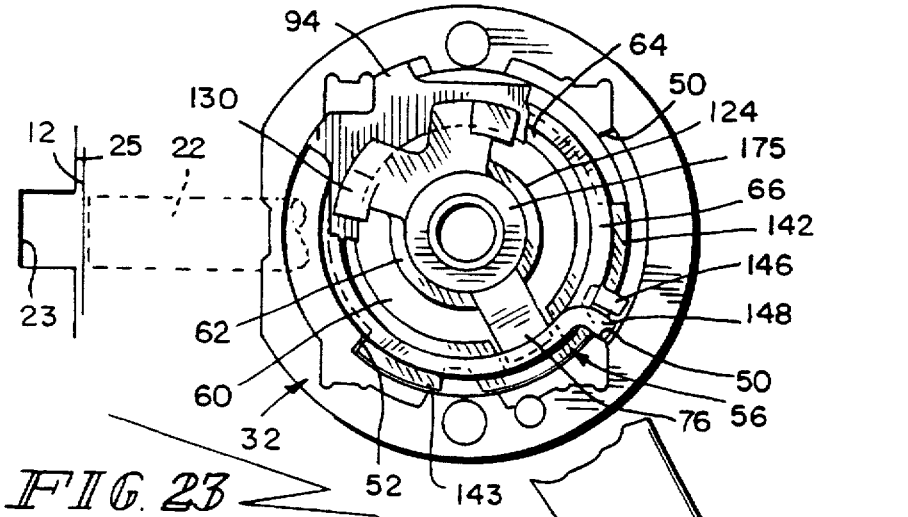
FIG. 23 is a view similar to FIG. 22 showing a spring drive plate after it has been moved to compress the torsion spring following rotation of the lever handle to retract the latch bolt.
Figure 24:
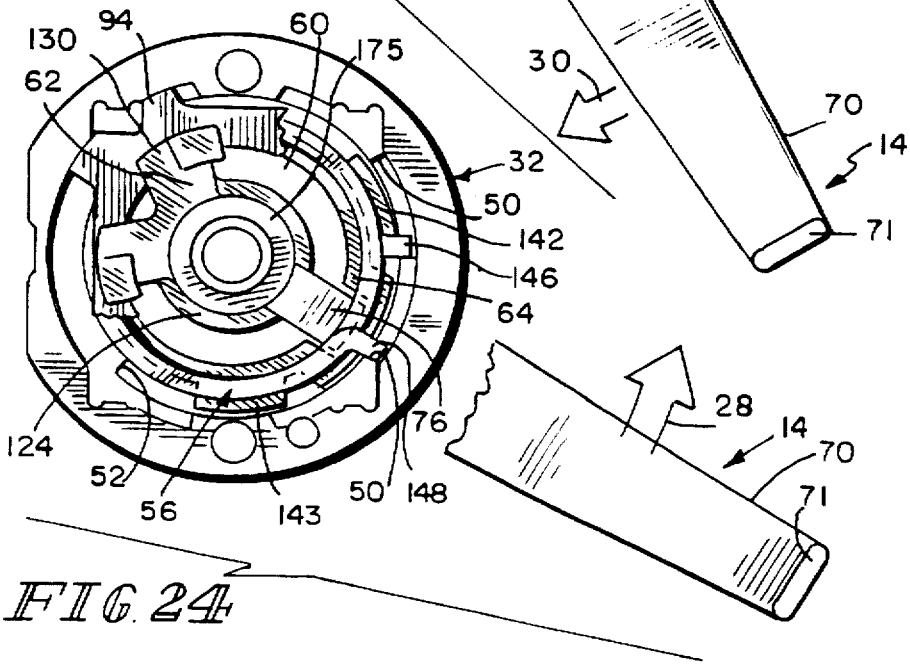
FIG. 24 is a view similar to FIG. 23 showing the torsion spring expanding to rotate the lever handle back to its horizontal home position after a user releases the lever handle.

Outer door handle 14 includes a lever base 68 and a lever arm 70. When not in use (i.e., not being rotated), the lever arm 70 lies in a horizontal home position as shown in FIG. 22. When the lever arm 70 is rotated to retract the latch bolt 22, the lever arm 70 is moved away from its horizontal home position as shown in FIG. 23. The lever return assembly 56 acts to return the lever arm 70 automatically to its horizontal home position after it has been rotated to operate latch bolt retractor assembly 18 as shown in FIG. 24 and then released by the user. Maintaining the lever arm 70 in its horizontal home position, usually parallel relative to the floor (not shown), improves the aesthetic appearance of the lockset 10.

The five-piece locking-unlocking assembly 58 is also shown in FIG. 2 prior to assembly and is designed to fit inside retractor control member 62. This assembly 58 includes a lost-motion drive member 72, a locking-control bushing 74, a locking lug 76, a drive pin 78, and a compression spring 80. The locking-unlocking assembly 58 operates to move the locking lug 76 back and forth along an axially extending path between the unlocked position shown in FIG. 4 and the locked position shown in FIG. 15. In the unlocked position, the locking lug 76 is situated to permit the two-piece retractor operator assembly 54 to operate and retract the latch bolt 22 away from the doorjamb 25 when the outer door handle 14 is rotated. In the locked position, the locking lug 76 is situated to prevent the outer spindle 60 from being rotated relative to the door 12 by outer door handle 14 so that the retractor operator assembly 54 is disabled.

Figure 8:
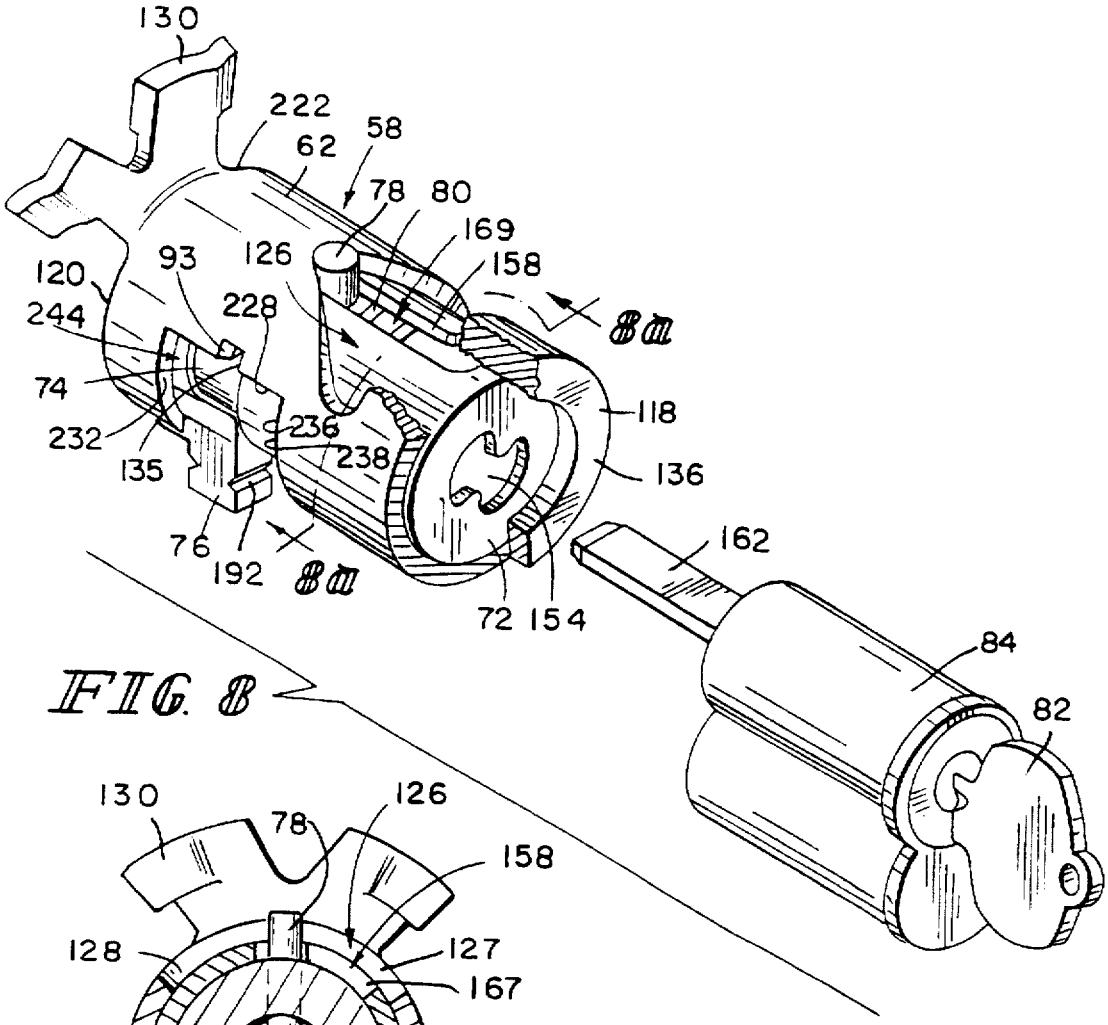
FIGS. 8–10*a* show how the components in the five-piece locking-unlocking assembly move relative to the retractor control member as a user turns an operating key to turn a throw member and cause a locking lug to move relative to the retractor control member from an unlocked position shown in FIG. 8 to a locked position shown in FIG. 10.

A user activates the five-piece locking-unlocking assembly 58 housed inside the retractor control member 62 either by (1) rotating an operating key 82 in a lock core such as key-removable figure-8-shaped lock core 84 mounted in outer lever handle 14, or (2) pushing a push button 86 mounted in an inner spindle 61 situated within inner lever handle 16. Either one of these actions positions the locking lug 76 in the locked position or the unlocked position. Pushing the push button 86 moves a button bar 88 shown, for example, in FIGS. 2 and 4 to position the locking lug 76 in the locked position or the unlocked position. In the illustrated embodiment, the lock core 84 is mounted in the lever base 68 of the outer door handle 14 and the push button 86 is mounted in the inner spindle 61 as shown in FIG. 4. In alternative embodiments, any combination of lock cores 84 and push buttons 86 may be used.

Figure 12:
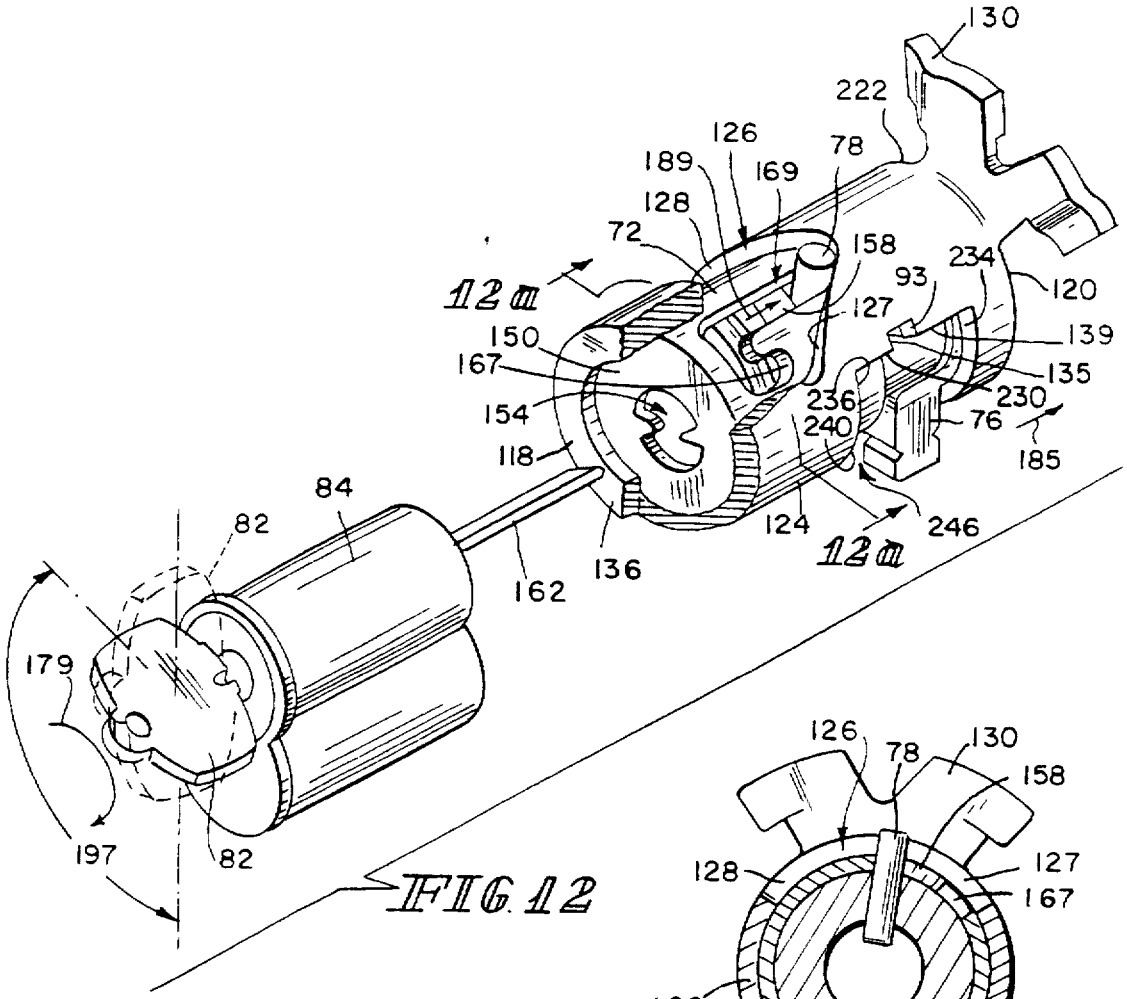
Figure 12M:
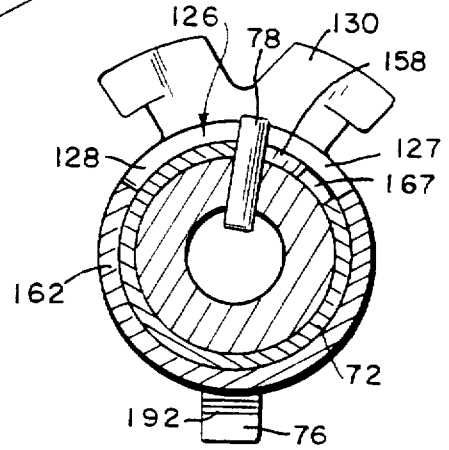

When unlocking the lockset 10, the operating key 82 is turned by the user in a clockwise direction 179 through a door-unlocking angle 197 of approximately 110° as shown in FIG. 12. This is because the operating key 82 must rotate approximately 93° relative to lock core 84 before the locking lug 76 begins to move inside the threaded outer hub 32 from its locked position toward its unlocked position.

Figures 10, 10A, 11, 11A:
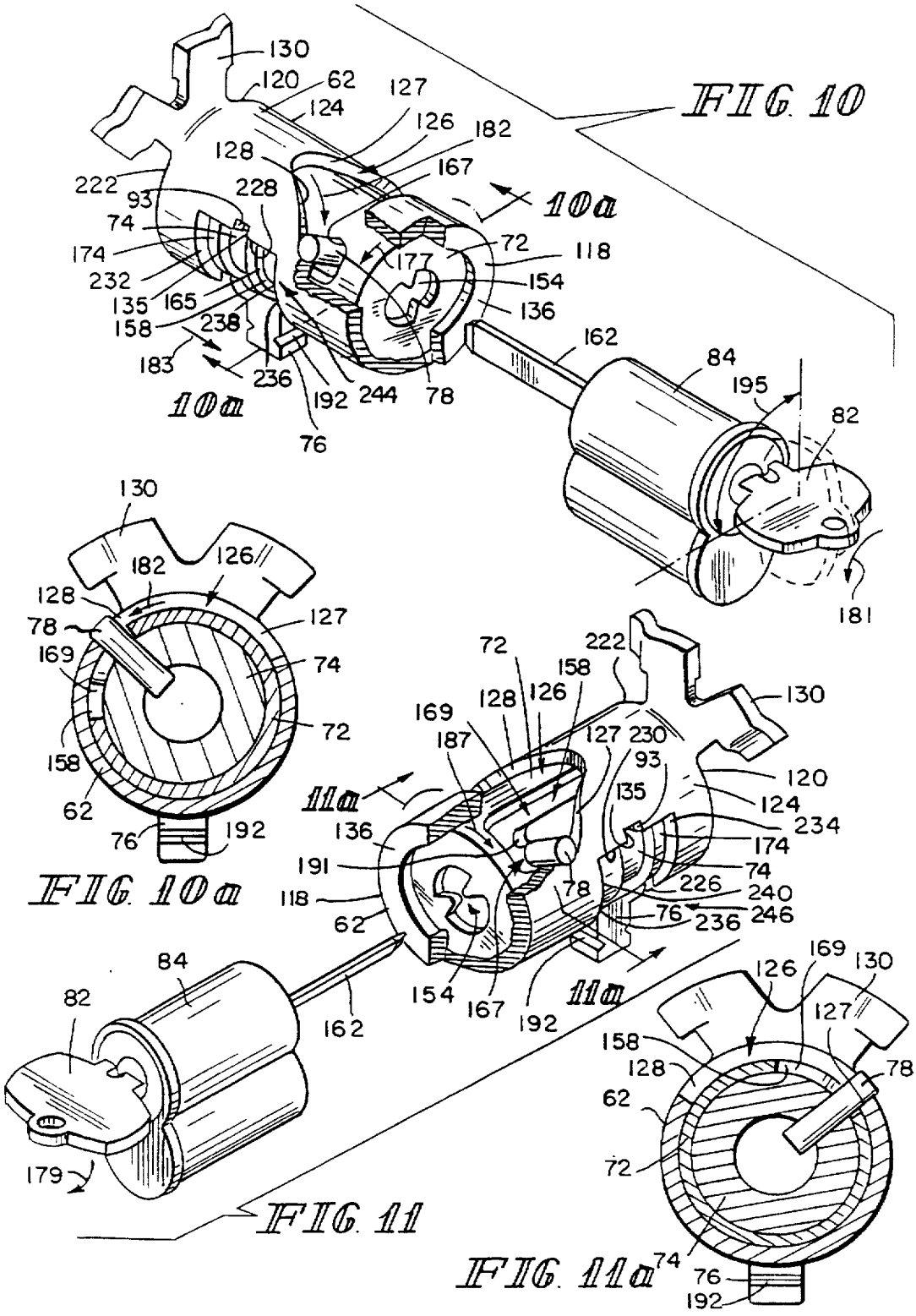
FIGS. 11–12*a* show how the components in the five-piece locking-unlocking assembly move relative to the retractor control member as a user turns the operating key in a clockwise direction to move the locking lug to its unlocked position.
FIG. 11*a* is a transverse sectional view taken along lines 11*a*—11*a* of FIG. 11 showing the lost-motion drive member after it has been rotated by the throw member to position the drive pin on the right side of the triangular drive pin-receiving slot formed in the retractor control member.

When locking the lockset 10, the operating key 82 is turned by the user in a counterclockwise direction 181 through a door-locking angle 195 of approximately 91° as shown in FIG. 10. In so doing, the locking lug 76 moves inside the threaded outer hub 32 from its unlocked position to its locked position.

The locking-unlocking assembly 58 is configured to provide a lost-motion drive connection between the throw member 162 and the lost-motion drive member 72 and between the lost-motion drive member 72 and the locking lug 76 so that the lever arm 70 of the outside door handle 14 will be able to rotate about axis 29 through a 93° latch bolt retraction-delay angle 194 once locking lug 76 is snapped or sheared during a torque attack on lockset 10. When the locking lug 76 shears and the lever handle 70 rotates through the 93° latch bolt retraction-delay angle, the locking-unlocking assembly 58 acts to move through at least a 93° lost-motion driving connection. The 93° lost-motion drive connection built into the locking-unlocking assembly 58 permits the outer door handle 14 to rotate through the 93° latch bolt retraction-delay angle before the drive pin 78 begins to rotate the retractor control member 62 or the locking lug 76 moves toward the unlocked position. Without the 93° lost-motion drive connection feature in the locking-unlocking assembly 58, either the drive pin 78 or the locking lug 76 would be positioned to begin retracting the latch bolt 22 to allow the door 12 to open after the locking lug 76 shears under a torque attack.

The two-piece retractor operator assembly 54, the lever return assembly 56, and the five-piece locking-unlocking assembly 58 are mounted to lie within the threaded outer hub 32 as shown in FIGS. 4 and 15. Essentially, the five-piece locking-unlocking assembly 58 is rotatably received inside the axially inner end of the two-piece retractor operator assembly 54 and the lever return assembly 56 is mounted at the axially inner end of the retractor operator assembly 54 as shown in FIGS. 4 and 15.

As shown in FIG. 2, the lockset 10 includes outer door handle 14, outer rose cover 90, outer rose liner 92, threaded outer hub 32, outer spindle 60, spring drive plate 64, torsion spring 66, retractor control member 62, retainer 93, lost-motion drive member 72, spring 80, locking-control bushing 74, locking lug 76, drive pin 78, button bar 88, and thrust plate 94. The thrust plate 94 acts as a bearing surface between the latch bolt retractor assembly 18 (shown in FIGS. 1 and 4) and the assemblies 54, 56, and 58.

The two-piece retractor operator assembly 54 functions to transmit rotation of the outer door handle 14 to the latch bolt retractor assembly 18 at the proper time when lockset 10 is unlocked. The two-piece retractor operator assembly 54 includes outer spindle 60 and retractor control member 62.

The outer spindle 60 is generally circular in cross-section as shown in FIG. 2 and is mounted within the central aperture 38 of the threaded outer hub 32 as shown in FIG. 4. The outer spindle 60 includes an outer end 96 facing axially away from the door 12 and an inner end 98 facing axially toward the door 12. An axially extending key slot 110 is formed at the inner end 98 of outer spindle 60. An axially extending locking lug-receiving slot 112 is also formed at the inner end 98 of outer spindle 60 and oriented to lie at an offset angle of approximately 180° from the axially extending key slot 110 as shown best in FIG. 2. Spaced-apart drive surfaces 113 are provided along each edge of the axially extending locking lug-receiving slot 112 as shown in FIG. 2 and are sized to engage locking lug 76.

Outer spindle 60 is also formed to include a central aperture 114 and a pair of drive prongs 116 as shown in FIG. 2. These drive prongs 116 extend axially outwardly away from the door 12. The drive prongs 116 extend into and engage drive lugs (not shown) formed on the inner circumference of the lever base 68 of outer handle 14. The engagement of the drive prongs 116 and the outer handle lever base 68 cause the outer spindle 60 always to rotate with the outer door handle 14 about axis of rotation 29.

The retractor control member 62 is mounted for rotation inside the central aperture 114 formed in the outer spindle 60 as shown in FIGS. 4 and 15. The retractor control member 62 is shown in detail in FIGS. 2 and **8–12*a* and includes an outer end 118 facing axially away from the door 12, an inner end 120 facing axially toward the door 12 and defining an end edge 222, as shown, for example, in FIGS. 2, 6, 7, 8, 9, 10, 11, 12, 17, 19, and 21; a longitudinally extending central aperture 122, and a cylindrical side wall 124. A triangular drive pin-receiving slot 126 is formed in the cylindrical side wall 124 and defines drive pin ramps 127, 128 for guiding and camming the drive pin 78 included in the locking-unlocking assembly 58 during locking and unlocking of lockset 10 as shown best in FIGS. 2 and 21. The drive pin ramps 127, 128 extend circumferentially with respect to the axis of rotation 29**.

The drive pin 78 has a width smaller than that of the triangular drive pin-receiving slot to permit a lost-motion driving connection between the retractor control member 62 and the locking-unlocking assembly 58. In alternative embodiments of the present invention, the drive pin-receiving slot formed in the retractor control member can be of any shape as long as the width of the drive pin-receiving slot is larger than the width of the drive pin.

The spaced-apart roll back cams 130 are appended to the axially inner end 120 of retractor control member 62 and extend radially outwardly away from the cylindrical side wall 124. As noted above, these roll back cams 130 are configured to engage and operate the latch bolt retractor assembly 18 when a user turns outer door handle 14 or turns key 82 to unlatch door 12. An annular support member 136 is also provided at the outer end 118 of retractor control member 62.

Figure 5:
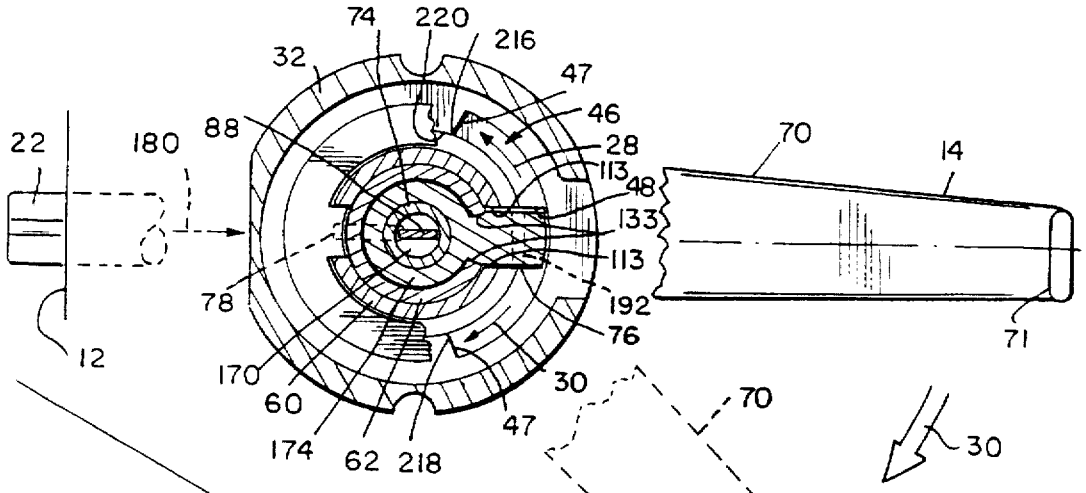
FIG. 5 is a transverse sectional view taken along line 5—5 of FIG. 4 showing the locking lug in a position linking the retractor control member to the outer spindle so that a user can rotate the outer spindle to rotate the retractor control member and thereby retract the latch bolt while the lockset is in its unlocked position.
Figure 6:
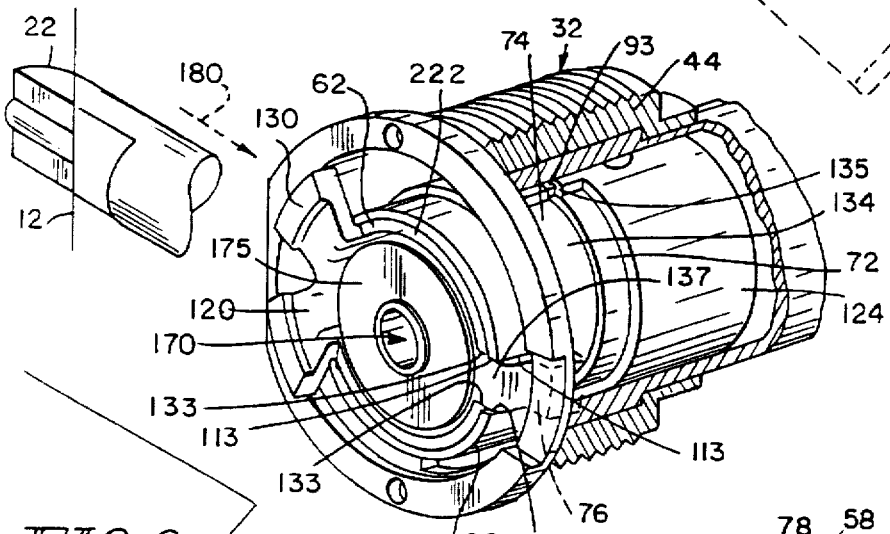
FIG. 6 is an enlarged perspective view of the outer hub of FIG. 5 showing the locking lug (in phantom) in its unlocked position lying in slots formed in the outer hub and the outer spindle.
Figure 7:
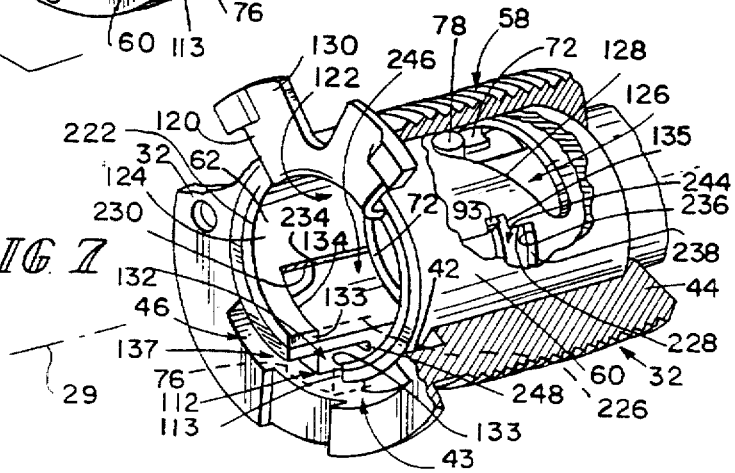
FIG. 7 is a view similar to FIG. 6 of the outer hub after it has been rotated 90° in a clockwise direction about a central axis, with portions of the outer hub and spindle broken away (and the locking control bushing omitted) to show a triangular drive pin-receiving slot formed in the retractor control member and a drive pin coupled to locking-control bushing and positioned to extend into the triangular drive pin-receiving slot.

The retractor control member 62 is formed to include several slots shown in FIGS. 2 and 7 for receiving the locking lug 76. The slots include an axially extending locking lug-receiving slot 132 formed in the cylindrical side wall 124 at the inner end 120 and a circumferentially extending slot 134 arranged to lie in communication with the axial locking lug slot 132 as shown best in FIG. 7. Spaced-apart drive surfaces 133 are formed along the edge of the axially extending locking lug-receiving slot 132 to engage locking lug 76 when the lockset 10 is unlocked as shown in FIGS. 5–7. The first and second drive surfaces 133 extend along substantially parallel first and second drive surface axes, 224, 226 respectively, as shown, for example, in FIGS. 7, 17, 19, and 21. The first and second drive surfaces axes 224, 226 are substantially parallel to axis of rotation 29 as shown, for example, in FIG. 17. Retainer receiving slots 135 are formed in the cylindrical side wall 124 at each end of circumferentially extending slot 134. The roll back cams 130 on retractor control member 62 engage and operate the latch bolt retractor assembly 18 to retract the latch bolt 22 when the retractor control member 62 is rotated in one of the door-opening directions 28, 30 by the lever-actuated outer spindle 60 or key 82.

The retractor control member 62 further includes first and second outer surfaces or side surfaces 228, 230 and first, second, and third arcuate surfaces 232, 234, 236 that define the circumferentially-extending retractor control member slot 134 as shown, for example, in FIGS. 2, 7, 8, 9, 10, 11, 12, and 17–21. The first and second outer surfaces 228, 230 are spaced apart from the first and second drive surface axes 224, 226 as shown, for example, in FIG. 17. The first arcuate surface 232 extends between the first drive surface axis 224 and the first outer surface 228 and is substantially parallel to the third arcuate surface 236 as shown, for example, in FIG.

9. The second arcuate surface 234 extends between the second drive surface axis 226 and second outer surface 230 and is substantially parallel to the third arcuate surface 236 as shown, for example, in FIG. 11. The third arcuate surface 236 extends between the first and second outer surfaces 228, 230 and includes a first outer section 238 extending between the first drive surface axis 224 and the first outer surface 228, a second outer section 240 extending between the second drive surface axis 226 and the second outer surface 230, and a middle section 242 extending between the first and second drive surface axes 224, 226, as shown, for example, in FIGS. 7, 8, 9, 10, 11, 12, 15, 17, 19, and 21. The first arcuate surface 232, first outer surface 228, first outer section 238 of the third arcuate surface 236, and the first drive surface axis 224 define a first outer region 244 of the circumferentially extending retractor control member slot 134, as shown, for example, in FIGS. 7, 8, 9, 10, 19, and 21. The second arcuate surface 234, second outer surface 230, second outer section 240 of the third arcuate surface 236, and the second drive surface axis 226 define a second outer region 246 of circumferentially extending retractor control member slot 134 as shown, for example, in FIGS. 7, 11, 12, 17, 19, and 21. The first and second drive surface axes 224, 226 and middle section 242 of third arcuate surface 236 define a middle region 248 of circumferentially-extending retractor control member slot 134 as shown, for example, in FIGS. 7, 19, and 21.

The retractor control member 62 is loosely fitted within central aperture 114 of the outer spindle 60 as shown in FIG. 4 so that the retractor control member 62 does not always rotate with the outer spindle 60. The retractor control member 62 rotates with the outer spindle 60 only when the locking lug 76 is positioned in the unlocked position shown in FIG. 4. Thus, the roll back cams 130 are in direct-torque-drive connection with the lever arm 70 of outer door handle 14 only when the locking lug 76 is in the unlocked position. This prevents a person from retracting the latch bolt 22 when locked by "yanking" on the lockset 10 because striking down or up on and then immediately jerking in direction 55 on the lever arm 70 will not cause the roll back cams 130 to rotate.

When assembled, the axially extending locking lug-receiving slot 112 of the outer spindle 60 and the axially extending locking lug-receiving slot 132 of the retractor control member 62 cooperate to form an axially extending channel 137 as shown in FIGS. 4 and 7. The locking lug 76 travels in and out of the channel 137 between the unlocked position shown in FIGS. 4 and 7 and locked position shown in FIGS. 15 and 17. The locking lug 76 moves in response to sliding movement of locking-control bushing 74 caused by either rotation of the drive pin 78 against the retractor control member 62 mounted on locking-control bushing 74 in the manner described below or by movement of the button bar 88.

The locking lug 76 serves at least three important functions in lockset 10. First, it connects the outer spindle 60 to the retractor control member 62 to rotate the retractor control member 62 in response to rotation of the outer spindle 60 when the lockset 10 is in the unlocked position to operate latch bolt retractor assembly 18. Second, locking lug 76 provides means for locking the outer door handle 14 against rotation by locking outer spindle 60 to outer hub 32 to block operation of latch bolt retractor assembly 18 by an unauthorized user or other person. Third, the locking lug 76 provides a positive stop for the lockset 10 in the unlocked position by engaging one of the travel-limiting faces 47 in the circumferential locking lug-receiving slot 46. This positive stop prevents damage to weaker components within the lockset 10.

In the unlocked position of lockset 10 shown in FIG. 4, the locking lug 76 is the main drive link between the outer spindle 60, (which spindle 60 is driven by the outer door handle 14), and the retractor control member 62 (which retractor control member 62 drives the latch bolt retractor assembly 18 to retract the latch bolt 22). In essence, the locking lug 76 acts as a key or rotation-transmitting link between the rotating outer spindle 60 and the rotatable retractor control member 62 inside the outer spindle 60.

In the locked position of lockset 10 shown in FIG. 15, the locking lug 76 is situated in the axially extending locking lug-receiving slot 48 formed in the threaded outer hub 32. This placement of locking lug 76 creates a locked condition between the outer hub 32 and the outer spindle 60 to prevent the outer door handle 14 from being rotated by a user to operate the latch bolt retractor assembly 18. If, in this lever handle-locking position, the locking lug 76 is overtorqued by a person and sheared by being forced against an adjacent-fixed surface (as shown in FIG. 18), an attached portion 77 of locking lug 76 will rotate through the 93° latch bolt retraction-delay angle in the circumferentially extending locking lug-receiving slot 134 formed in the retractor control member 62 before it can be moved far enough to establish a direct-torque-drive connection with the retractor control member 62 carrying the roll back cams 130 engaging latch bolt retractor assembly 18.

The lever handle return assembly 56 functions to urge the lever arm 70 of outer door handle 14 to its horizontal home position once the lever arm 70 is released by a user. Lever handle return assembly 56 includes spring drive plate 64 and torsion spring 66. Operation of the lever handle return assembly 56 is described in the following paragraphs.

The operation of the lever handle return assembly 56 to return the lever arm 70 to its horizontal home position after it is released by a user is illustrated in FIGS. 22–24. When not in use (i.e., not being rotated), the lever arm 70 lies in a horizontal home position as shown in FIGS. 1 and 22. Generally, the horizontal home position of the lever arm 70 is a horizontal orientation relative to the underlying floor (not shown). When a user rotates the lever arm 70 relative to the door 12 in direction 30 as shown in FIG. 23 to retract the latch bolt 22 from the doorjamb 25, the lever arm 70 is moved away from its horizontal home position to an operating position. The spring drive plate 64 and torsion spring 66 cooperate with the outer spindle 60 to urge the lever arm 70 automatically toward its horizontal home position as shown in FIG. 24 after the lever arm 70 has been rotated to actuate the latch bolt retractor assembly 18 and then released.

The spring drive plate 64 is generally circular in shape as shown in FIGS. 2 and 22. Spring drive plate 64 includes a central aperture 138, a key 140 extending in a radially inward direction toward the axis of rotation 29 of lockset 10, spaced-apart spring lugs 142, 143 extending in an axially inward direction toward the door 12, and a locking lug-receiving channel 144. The locking lug-receiving channel 144 has a generally square shape, is offset at an angle of approximately 180° from the key 140, and extends in a radially outward direction away from the axis of rotation 29. The spring drive plate 64 is mounted on the inner end 98 of the outer spindle 60 by inserting the key 140 of the spring drive plate 64 into the key slot 110 of the outer spindle 60.

The torsion spring 66 in lever handle return assembly 56 is mounted in a protected chamber 43 inside hooded portion 42 of outer hub 32 to lie adjacent to the spring drive plate 64. The spring drive plate 64 is placed between the torsion spring 66 and the inner end 98 of the outer spindle 60. The torsion spring 66 includes spaced-apart spring fingers 146, 148 that engage the spaced-apart spring lugs 142, 143 of the spring drive plate 64 as shown in FIGS. 22–24. To install the torsion spring 66, the torsion spring 66 is compressed so that the spring fingers 146, 148 engage the spring finger-engaging surfaces 50 formed in the threaded outer hub 32. Thus, the spring fingers 146, 148 of the torsion spring 66 engage both the spaced-apart spring finger-engaging surfaces 50 of the threaded outer hub 32 and the spring lugs 142, 143 of the spring drive plate 64.

When lever arm 70 is rotated away from its horizontal home position manually by a user to retract the latch bolt 22 and open the door 12, the torsion spring 66 is further compressed as shown in FIG. 23. The lever arm 70 and outer spindle 60 rotate together and the outer spindle 60 rotates the spring drive plate 64 through the key 140 and key slot 110 engagement. Then, the spring drive plate 64 compresses the torsion spring 66 by transmitting the rotation through the spring lugs 142, 143 of the spring drive plate 64 to the spring fingers 146, 148 of the torsion spring 66. Specifically, for rotation of lever arm 70 in direction 30, the torsion spring 66 compresses because the spring finger 148 is held in place by the spring finger-engaging surface 50 of the outer hub 32 while the spring finger 146 is rotated toward the spring finger 148 by the spring lug 142 of the spring drive plate 64 as shown in FIG. 23. Rotation of lever arm 70 in direction 28 results in spring finger 146 being held in place while spring finger 148 is rotated toward the spring finger 146 by the spring lug 143.

Once the user releases his or her grip on lever arm 70 after opening of the door 12, the torsion spring 66 expands and rotates the spring drive plate 64 and outer spindle 60 in direction 28 to urge the lever arm 70 toward its horizontal home position as shown in FIG. 24. The spring finger 146 exerts a force on the spring lug 142 to return the spring finger 146 to the spring finger-engaging surface 50. The force that rotates the spring finger 146 back to the spring finger-engaging surface 50 also rotates the lever arm 70 back to its horizontal home position.

The five-piece locking-unlocking assembly 58 functions to control the position of the locking lug 76 so as to control locking and unlocking of the lockset 10. Locking-unlocking assembly 58 includes lost-motion drive member 72, locking-control bushing 74, drive pin 78, locking lug 76, and compression spring 80. Operation of the locking-unlocking assembly 58 is described in the following paragraphs.

The lost-motion drive member 72 is a cylindrical element as shown in FIGS. 2 and 2*a* that is mounted for rotation inside the central aperture 122 of the retractor control member 62 as shown in FIGS. 4 and 8–12*a*. The lost-motion drive member 72 includes an outer end 150 facing axially away from the door 12 and lying adjacent to the annular support member 136 of the retractor control member 62 and an inner end 152 facing axially toward the door 12. A "butterfly-shaped" throw member-receiving aperture 154 is formed in the outer end 150. The lost-motion drive member 72 further includes a cylindrical side wall 156. A drive in-receiving slot 158 is formed in the cylindrical side all 156 and a central aperture 160 extends longitudinally through lost-motion drive member 72.

The lost-motion drive member 72 is biased against axially inward movement by the retainer 93 mounted in the retainer-receiving slots 135 formed in the retractor control member 62 as shown in FIGS. 8, 9, 10, 11, and 12. These retainer receiving slots 135 lie adjacent to the inner end 152 of the lost-motion drive member 72. The lost-motion drive member 72 is biased against axially outward movement by the annular support member 136 of the retractor control member 62.

The key-removable lock core 84 is shown in FIGS. 2 and 4 and includes a blade-like throw member 162 that is situated to extend into the butterfly-shaped throw member-receiving aperture 154. As shown, for example, in FIGS. 8–12*a*, the throw member 162 is rotated in lock core 84 when a properly coded operating key 82 is inserted by a user into the lock core 84 and then rotated.

When the operating key 82 is rotated within the lock core 84, the throw member 162 may rotate within the butterfly-shaped throw member-receiving aperture 154 formed in lost-motion drive member 72 through a lost-motion angle before rotating the lost-motion drive member 72 relative to the surrounding retractor control member 62. The throw member-receiving aperture 154 is configured to provide a total lost-motion angle of 95° but the throw member 162 is situated within the throw member-receiving aperture 154 such that it only travels through a portion of the lost-motion angle of 95° before engaging the lost-motion drive member 72 and rotating the lost-motion drive member 72 about central axis 29 relative to the surrounding retractor control member 62.

The locking-control bushing 74 is a tube-like sleeve shown in FIG. 2. Locking-control bushing 74 includes an outer end 164 facing axially away from the door 12, an inner end 166 facing axially toward the door 12, a cylindrical body 168, a button bar-receiving aperture 170 extending from the inner end 166 to the outer end 164, and a drive pin-receiving aperture 172 in the cylindrical body 168 situated near the outer end 164. The locking-control bushing 74 is mounted for back-and-forth axial sliding movement and for rotational movement inside the central aperture 160 of the elongated cylindrical lost-motion drive member 72. Drive pin 78 fixes the locking-control bushing 74 to the lost-motion drive member 72 and the retractor control member 62 so that these three components can rotate together as a unit in the manner described below. As shown in FIG. 4, the drive pin 78 extends from the drive pin-receiving aperture 172 of the locking-control bushing 74 through the drive pin-receiving slots 126, 158 formed in the retractor control member 62 and the lost-motion drive member 72.

Basically, drive pin 78 acts to transmit the rotation imparted to the lost-motion drive member 72 by the key-actuated rotating throw member 162 to the locking-control bushing 74. The drive pin 78 also travels axially inwardly and outwardly relative to the door 12 and thus also moves the locking-control bushing 74 back-and-forth in axially inward and outward directions relative to the door 12.

The locking lug 76 is mounted on locking-control bushing 74 as shown best in FIG. 2. Locking lug 76 includes a collar 174 that is mounted to lie around the cylindrical body 168 of the locking-control bushing 74 at its inner end 166 as shown in FIG. 2. The locking lug 76 is rotatable relative to the locking-control bushing 74.

This feature allows the locking lug 76 to move axially inwardly and outwardly in response to sliding movement of the locking-control bushing 74 relative to the surrounding retractor control member 62 yet rotate relative to the locking-control bushing 74 whenever the locking-control bushing 74 is unable to rotate about the central axis 29 of lockset 10. A washer 175 is mounted on the inner end 166 of the locking-control bushing 74 as shown in FIGS. 4 and 6 to hold the locking lug 76 on the locking-control bushing 74 and allow the locking lug 76 to rotate relative to the locking-control bushing 74.

The locking lug 76 is situated within the channel 137 formed by the axially extending locking lug-receiving slots 112, 132 of the outer spindle 60 and retractor control member 62 as shown in FIG. 17. The locking lug-receiving channel 144 of the spring drive plate 64 permits the locking lug 76 to pass through the central aperture 138 of the spring drive plate 64 as it travels through the channel 137. When the locking lug 76 is positioned in an axially inward position relative to the door 12 as shown in FIG. 4, the lockset 10 is in the unlocked position. When the locking lug 76 is positioned in the axially outward position relative to the door 12 as shown in FIG. 15, the lockset 10 is in the locked position.

A compression spring 80 is included in locking-unlocking assembly 58 and is shown in FIG. 2. Compression spring 80 is positioned within the central aperture 160 of the lost-motion drive member 72 to lie between the outer end 150 of the lost-motion drive member 72 and the outer end 164 of the locking-control bushing 74. The compression spring 80 yieldably biases the locking-control bushing 74, drive pin 78, and locking lug 76 toward the axially inward unlocked position as shown in FIG. 4.

The outer rose cover 90 is mounted over the outer rose liner 92 on the outside of the door 12 as shown in FIGS. 1 and 4. The outer rose cover 90 includes a central aperture 178 through which the lever base 68 of outer door handle 14, neck 40 of the threaded outer hub 32, and the outer spindle 60 extend as shown in FIGS. 4 and 15. The outer rose cover 90 protects the lockset 10 by shielding all components of the lockset 10 except for the outer door handle 14. The outer rose liner 92 is rigidly fixed to the door 12 by posts 176 riveted into the outer rose liner 92 and mated with thru-bolt screws (not shown) as shown in FIG. 1. The inner circumference of the outer rose liner 92 is threaded at 45 to mate with the threaded outer circumference of the body 44 of the outer hub 32. In addition to being fixed to the door 12 by the posts 176, the outer rose liner 92 is held in place by being threaded onto the outer hub 32.

In use, lockset 10 is operable to lock and unlock door 12. The lockset 10 is shown in FIGS. 4–17 in an unlocked position with the locking lug 76 being positioned axially inwardly relative to the door 12. As shown in FIGS. 4 and 5, locking lug 76 is positioned to lie in and swing through the annular circumferentially extending locking lug-receiving slot 46 formed in the threaded outer hub 32 when the lockset 10 is unlocked and the outer door handle 14 is rotated about its axis of rotation 29.

Illustrations of the retractor control member 62 and outer spindle 60 inside the threaded outer hub 32 when the lockset 10 is in its unlocked condition are provided in FIGS. 6 and 7. FIG. 6 shows the outer hub 32, outer spindle 60, retractor control member 62, lost-motion drive member 72, locking-control bushing 74, and locking lug 76 in their assembled position. To provide a clearer illustration, the spring drive plate 64, torsion spring 66, and button bar 88 are not shown in FIG. 6. FIG. 7 is similar to FIG. 6 except that the assembly is rotated 90° clockwise about the central axis 29, the locking-control bushing 74 is removed, and the locking lug 76 is now shown transparently.

In the unlocked position, a direct torque-drive connection between the lever arm 70 and the roll back cams 130 is established. The locking lug 76 acts as a key to transfer the rotation of the outer spindle 60 to the retractor control member 62 to establish the direct torque-drive connection.

As shown in FIGS. 6–7, the locking lug 76 is situated in the axially extending channel 137 defined by the axially extending locking lug-receiving slot 112 in the outer spindle 60 and the adjacent axially extending locking lug-receiving slot 132 in retractor control member 62. When the locking lug 76 is in its axially inward unlocked position, it is situated to engage the two drive surfaces 113 formed in outer spindle 60 and two drive surfaces 133 formed in the retractor control member 62. The locking lug 76 is also situated to lie within the annular circumferentially extending locking lug-receiving slot 46 formed in the outer hub 32. It will be understood that in this position, the locking lug 76 keys the retractor control member 62 to rotate with the surrounding outer spindle during turning of lever arm 70. The outer spindle 60 and retractor control member 62 rotate together because the locking lug 76 rotates freely within the annular, circumferentially extending locking lug-receiving slot 46 formed in outer hub 32 in response to rotation of the lever arm 70. As the retractor control member 62 is rotated with the outer spindle 60, the roll back cams 130 on the retractor control member 62 move to engage and operate the door latch bolt retractor assembly 18 to retract the latch bolt 22 in direction 180 as shown in FIGS. 5 and 6.

The outer lever arm 70 can be rotated by a user in either direction 30 or direction 28 approximately 60 ° until the locking lug 76 moves in annular slot 46 to engage one of the locking lug travel-limiting faces 47 situated on opposite ends of the circumferentially-extending locking lug-receiving operating slot 46. The locking lug travel-limiting faces provide a positive stop for the locking lug 76 to prevent damage to weaker components in the lockset 10. The rotation by the lever arm 70 is also limited by spring lug travel-limiting faces 52 formed in the outer hub 32. As shown in FIG. 23, the spring lugs 142, 143 of the spring drive plate 64 engage the faces 52 to stop rotation of the lever arm 70 after the lever arm 70 rotates approximately 60 ° in either direction 30 or direction 28.

The locking lug 76 can be moved between its axially inward unlocked position and its axially outward locked position by using push button 86 or rotating an operating key 82 in the lock core 84 to operate the locking-unlocking assembly 58. The push button 86 mounted in the inner spindle 61 can be used to move the locking lug 76 between its axially inward unlocked position and its axially outward locked position. The locking lug 76 is shown in FIG. 4 in its axially inward unlocked position. To move the locking lug 76 axially outward away from the door 12, the push button 86 is pushed to move in an axially inward direction towards the door 12 to move the elongated button bar 88 in that same direction. The push button 86 must be "pushed" with enough force to overcome the biasing force of compression spring 80 that is mounted in the lost-motion control member 72. The movement of the button bar 88 moves the locking-control bushing 74, the drive pin 78, and the locking lug 76 in an axially outward direction relative to the door 12 to position the locking lug 76 in its locked position.

To hold the locking lug 76 in the axially outward locked position, the button bar 88 includes a pair of nose cams 184 which ride across the edges of a catcher bar 186 carried by the latch bolt retractor assembly 18. The catcher bar 186 is spring-biased toward the button bar 88 by a spring 188. When the button bar 88 is moved to position the locking lug 76 in the locked position, the nose cams 184 pass the edges of the catcher bar 186 and the edges of the catcher bar 186 drop into notches behind the nose cams 184 to lock the button bar 88 in a locked position.

In preferred embodiments, the push button 86 permits the inner door handle 16 to rotate when locked. When the inner door handle 16 rotates, it is able to unlock the door 12. For example, if the inner door handle 16 rotates the button bar 88, the button bar 88 will rotate out of the catcher bar 186 and spring 80 will move the locking-control bushing 74, drive pin 78, and locking lug 76 to their axially inwardly unlocked position.

Alternative embodiments may have a push-and-turn button (not shown) that uses a retaining assembly (not shown) situated in the inner spindle 61 to hold the button bar 88 in the locked position. With a push-and-turn button (not shown), the door does not become unlocked when the inner door handle is rotated because the button bar is held in place by the retainer assembly and not the catcher bar.

Operation of the locking-unlocking assembly 58 during locking of lockset 10 is shown in FIGS. 8–10*a* and unlocking of lockset 10 is shown in FIGS. 11–12*a*. As noted previously, locking-unlocking assembly 58 is a five-piece assembly including a lost-motion drive member 72, a locking-control bushing 74, a locking lug 76, a drive pin 78, and a compression spring 80. The components of the locking-unlocking assembly 58 move from the unlocked position, shown in FIG. 8, through an intermediate position, shown in FIG. 9, to the locked position shown in FIG. 10. The components of the locking-unlocking assembly 58 move from the locked position, shown in FIG. 10, through an intermediate position, shown in FIG. 11, to the unlocked position shown in FIG. 12.

The locking-unlocking assembly 58 is designed to provide a lost-motion driving connection so that the operating key 82 rotates within the lock core 84 through a door-locking angle 195 of approximately 91° before the locking lug 76 is moved from its unlocked position to its locked position and a door-unlocking angle 197 of approximately 110° before the locking lug 76 is moved from its locked position to its unlocked position. The lost-motion driving connection is built into the locking-unlocking assembly 58 so that when a person overtorques lockset 10 and causes locking lug 76 to shear, door handle 14 can be rotated by the person through the controlled latch bolt retraction-delay angle of approximately 93° before latch bolt 22 begins retracting from doorjamb 25.

The lost-motion driving connection is built into locking-unlocking assembly 58 in two "locations". First, throw member 162 rotates through a lost-motion angle within the throw member-receiving aperture 154 formed in lost-motion drive member 72 before rotating lost-motion drive member 72. Second, once lost-motion drive member 72 begins rotating, a lost motion driving connection is achieved as drive pin 78 moves through drive-pin receiving slots 126, 158 formed in retractor control member 62 and lost-motion drive member 72 without moving locking lug 76. The rotation of throw member 162 within throw member-receiving aperture 154 and the movement of drive pin 78 through drive pin-receiving slots 126, 158 is discussed in detail below.

A preferred embodiment of drive pin-receiving slot 158 formed in lost-motion drive member 72 is shown best in FIG. 2*a*. FIG. 2*a* is an enlarged view showing the shape of drive pin-receiving slot 158 as it would appear if the lost-motion drive member 72 was a flat plate. The drive pin-receiving slot 158 includes a longitudinally extending portion 169, an unlocking notch 165 at the axially inner end of drive pin-receiving slot 158 as shown in FIGS. 2 and 8, a locking notch 167 at the axially outer end of drive pin-receiving slot 158, an axially inner wall 151 situated between unlocking notch 165 and longitudinally extending portion 169, and an axially outer wall 153 situated between locking notch 167 and longitudinally extending portion 169 as shown in FIG. 2*a*.

Spaced-apart first and second side walls 171, 173 cooperate to define longitudinally extending portion 169 therebetween. The first side wall 171 extends parallel to the axis of rotation 29 and the second side wall 173 extends at an angle 193 relative to the first side wall 171 and axis of rotation 29 as shown in FIG. 2A.

A detent 191 is situated adjacent to second side wall 173 between longitudinally extending portion 169 and locking notch 167 as shown in FIGS. 2 and 2A. Drive pin 78 is situated in locking notch 167 when lockset 10 is in the locked position. The detent 191 retains the drive pin 78 in the locking notch 167 until operating key 82 is used to unlock lockset 10. When the lockset 10 is in the unlocked position, the drive pin 78 is situated in unlocking notch 165 or the axially inner side of longitudinally extending portion 169 as discussed in detail below.

Figure 8A:
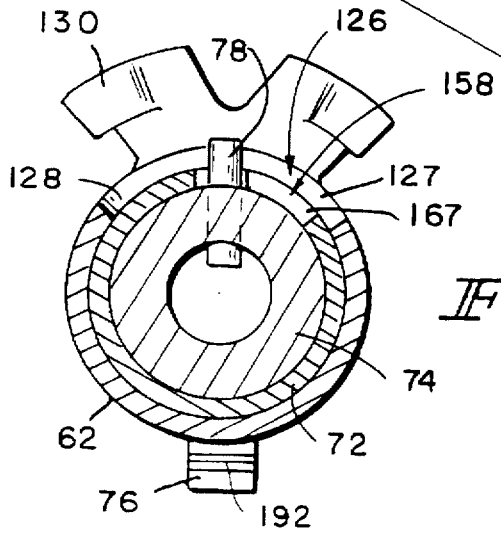
FIG. 8*a* is a transverse sectional view taken along line 8*a*—8*a* of FIG. 8 showing the drive pin in the center of the triangular drive pin-receiving slot formed in the retractor control member.
Figure 9:
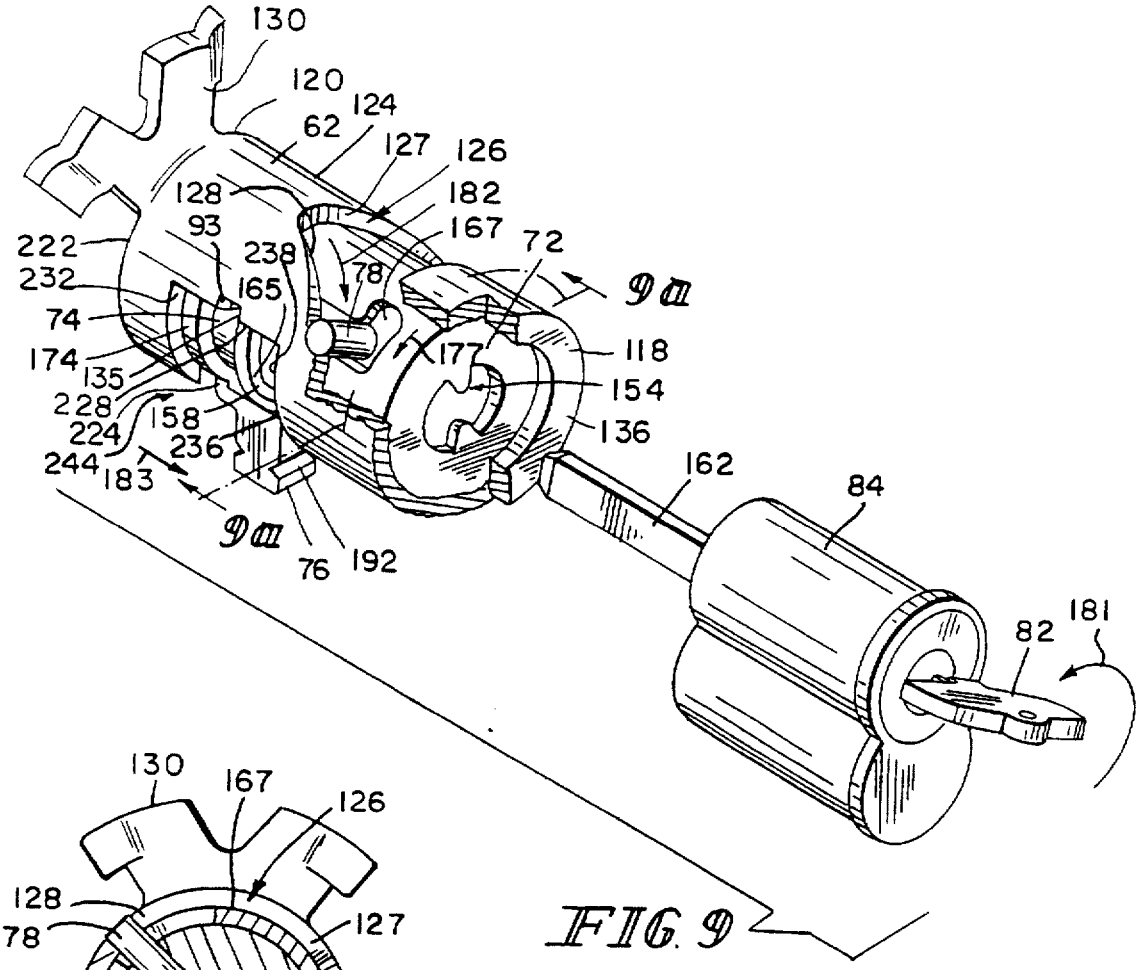
Figure 9A:
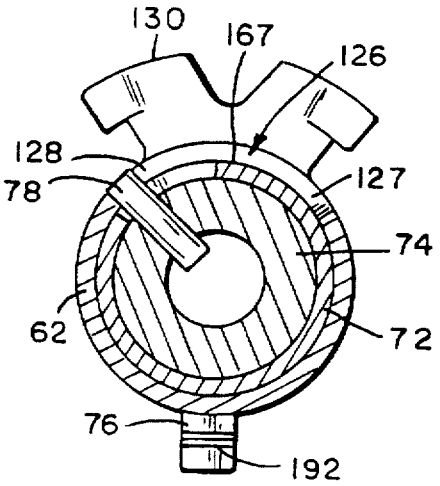
FIG. 9*a* is a transverse sectional view taken along line 9*a*—9*a* of FIG. 9 showing the lost-motion drive member having rotated the drive pin to engage the drive pin ramp located on the left side of the triangular drive pin-receiving slot formed in the retractor control member.

The operation of locking the lockset 10 is illustrated in FIGS. 8–10*a*. When the drive pin 78 is in the unlocked position, it is situated in the axially inward position as shown in FIGS. 8 and 8*a*. Counterclockwise rotation of operating key 82 in direction 181 in lock core 84 moves the drive pin 78 axially outward in "diagonal" direction 182 toward the locked position as shown in FIGS. 9 and 9*a*. Further counterclockwise rotation of operating key 82 positions the drive pin 78 in the locking notch 167 to hold the drive pin 78 in the locked position as shown in FIG. 10.

To lock the door 12, operating key 82 is inserted into the lock core 84 and rotated in a counterclockwise direction 181. The operating key 82 travels through the door-locking angle of 91° while locking lug 76 moves from its unlocked position to its locked position.

When the lockset 10 is in the unlocked position, the position of the throw member 162 within the butterfly-shaped throw member-receiving aperture 154 of the lost-motion drive member 72 does not permit any lost motion rotation between the throw member 162 and the lost-motion drive member 72 for counterclockwise key 82 rotation. Thus, there is no lost motion between throw member 162 and lost-motion drive member 72 when the lockset 10 is being locked.

All of the lost motion present in the locking operation is from the drive pin 78 travelling through the drive pin-receiving slots 126, 158. Counterclockwise rotation of the operating key 82 in counterclockwise direction 181 rotates the throw member 162 which engages and rotates the lost-motion drive member 72 in direction 177 as shown in FIG. 9. The lost-motion drive member 72 engages and rotates the drive pin 78 and permits the drive pin 78 to translate axially outward through the longitudinally extending portion 169 of the drive pin-receiving slot 158 formed in the lost-motion drive member 72. The drive pin 78 moves axially during rotation of the lost-motion drive member 72 by riding on the drive pin ramp 128 formed along one edge of the triangular drive pin-receiving slot 126 formed in the retractor control member 62. The second side wall 173 of the drive pin-receiving slot 158 drives the drive pin 78 along the drive pin ramp 128. As shown in FIGS. 8–9*a*, the drive pin 78 travels in diagonal direction 182 from its axially inward position to its axially outward position. The second side wall 173 is situated at angle 193 relative to the axis of rotation 29 to assist moving drive pin 78 along the drive pin ramp 128 in diagonal direction 182. The operating key 82 rotates approximately 65° while the drive pin 78 travels in diagonal direction 182 through the longitudinally extending portion 169 of the drive pin-receiving slot 158 from its axially inward position to its axially outward position.

After travelling along drive pin ramp 128 through the longitudinally extending portion 169 in "diagonal" direction 182 as shown in FIGS. 9 and 9*a*, the lost-motion drive member 72 rotates in direction 177 to situate drive pin 78 in locking notch 167 in response to further operating key 82 rotation in counterclockwise direction 181 as shown in FIGS. 10 and 10*a*. The operating key 82 rotates approximately another 26° while the lost-motion drive member 72 rotates to move the drive pin 78 from the longitudinally extending portion 169 to the locking notch 167.

Once lockset 10 is in the locked position, additional counterclockwise rotation 181 of the operating key 82 past 91° rotates the retractor control member 62 to retract the latch bolt 22. However, this further counterclockwise rotation 181 does not move the lockset 10 out of the locked position.

Clockwise rotation of the operating key 82 in the unlocked position does not lock the lockset 10 but rather only retracts the latch bolt 22. For clockwise key 82 rotation in the unlocked position, the operating key rotates 108° before the drive pin 78 is rotated into unlocking notch 165 to rotate the retractor control member 62 and thus begin retracting the latch bolt 22.

More specifically, for clockwise key 82 rotation in the unlocked position, the operating key 82 rotates 95° while the throw member 162 travels through the butterfly-shaped throw member-receiving aperture 154 without engaging and rotating the lost-motion drive member. After the initial 95° clockwise operating key 82 rotation, the operating key 82 rotates the lost-motion drive member 72 13° in the clockwise direction 179 without the lost-motion drive member 72 rotating drive pin 78. This 13° rotation of lost-motion drive member 72 situates drive pin 78 in unlocking notch 165. Once drive pin 78 is situated in the unlocking notch 165, further clockwise rotation of the operating key 82 rotates the retractor control member 62 to retract the latch bolt 22.

The operating key 82 has a home position in which the key 82 can be inserted into and removed from the lock core 84. When the operating key 82 is inserted into the lock core 84 and rotated, the operating key 82 is moved away from its home position. To remove the operating key 82 from the lock core 84, the operating key 82 must be rotated back to its home position. For example, if the operating key was rotated in the clockwise direction 179 108°, then to remove the operating key 82 from the lock core 84, the operating key 82 must be rotated 108° in the counterclockwise direction 181.

After the operating key 82 is rotated 91° in the counterclockwise direction 181 to lock the lockset 10, then to remove the operating key 82 from the lock core 84, the operating key 82 must be rotated 91° in the clockwise direction 179. The 91° clockwise rotation of the operating key 82 does not rotate the lost-motion drive member 72 because the throw member 162 travels through the butterfly-shaped throw member receiving aperture 154 without rotating the lost-motion drive member 72.

When the lockset 10 is in the locked position and the operating key 82 has been removed from the lock core 84, the throw member 162 is positioned within the butterfly-shaped throw member-receiving aperture 154 so that there is 4° clearance between the throw member 162 and the lost-motion drive member 72 in the clockwise direction 179 and 91° clearance between the throw member 162 and the lost-motion drive member 72 in the counterclockwise direction 181.

If a person overtorques the lockset 10 causing the locking lug 76 to shear, the throw member 162 rotates as the person rotates the lever arm 70. After the locking lug 76 shears, the person can rotate the lever arm 70 in both direction 28 and direction 30 through the 93° latch bolt retraction-delay angle 194 before either the drive pin 78 or locking lug 76 begin to rotate the retractor control member 62 to retract the latch bolt 22 to allow the door 12 to open.

If the person overtorques the lockset 10 and rotates the lever arm 70 in direction 28, the lever arm 70 rotates through the approximately 93° latch bolt retraction-delay angle 194 before the retractor control member 62 begins rotating. The lever arm 70 is able to rotate through the 93° latch bolt-retraction delay angle 194 without the latch bolt 22 being retracted because there is 94.5° lost motion built into the locking-unlocking assembly 58 for lever arm 70 rotation in direction 28.

The lost motion is built into the locking-unlocking assembly 58 as follows. As the lever arm 70 rotates in direction 28 after the lockset 10 is overtorqued, the throw member 162 rotates through 4° lost motion within the butterfly-shaped throw member-receiving aperture 154 before engaging and rotating the lost-motion drive member 72. Then, within the remaining 90.5° lost motion, the throw member 162 rotates the lost-motion drive member 72 and drive pin 78, held in locking notch 167, without the drive pin 78 engaging drive pin ramp 127 formed along one edge of the triangular drive pin-receiving slot 126 formed in the retractor control member 62.

Because the drive pin 78 does not engage the drive pin ramp 127, the drive pin 78 does not pop out of locking notch 167 and the sheared locking lug 76 remains in the circumferentially extending locking lug-receiving slot 134. Once the locking lug 76 contacts the side edge 228 of circumferentially extending locking lug-receiving slot 134, further rotation of the lever arm 70 by the person begins retracting the latch bolt 22. The latch bolt 22 does not completely retract because the lever arm 70 engages the door frame 24 and prevents further rotation of the lever arm 70 before the lever arm 70 rotates enough to completely retract the latch bolt 22.

If the person overtorques the lockset 10 and rotates the lever arm 70 in direction 30, the lever arm 70 rotates through the 93° latch bolt retraction-delay angle 194 before the spindle 60 drives the locking lug 76 into contact with the side edge 228 of circumferentially extending locking lug-receiving slot 134 formed in retractor control member 62 or drive pin 78 engages retractor control member 62 to rotate retractor control member 62 and retract the latch bolt 22. The locking-unlocking assembly 58 has lost motion built in so that lever arm 70 can be rotated in direction 30 through the 93° latch bolt retraction-delay angle 194 before the latch bolt 22 begins retracting.

As the lever arm 70 rotates in direction 30 after the lockset 10 is overtorqued, the throw member 162 rotates through 91° lost motion within the butterfly-shaped throw member-receiving aperture 154 before engaging and rotating the lost-motion drive member 72. Another 2° of the lost-motion is achieved because the drive pin 78 has a smaller diameter than the diameter of the drive pin receiving slot 158.

After the 93° rotation in direction 30, either the lost-motion drive member 72 will rotate the drive pin 78 against the retractor control member 62 to retract the latch bolt 22 or the spindle will rotate the sheared locking lug 76 against the retractor control member 62 to retract the latch bolt 22. Once again, the lever arm 70 engages the door frame 24 and prevents further rotation of the lever arm 70 before the lever arm 70 rotates enough to completely retract the latch bolt 22.

The operation of unlocking the lockset 10 is shown in FIGS. 11–12*a*. To move the locking lug 76 to its axially inward unlocked position, the operating key 82 is rotated clockwise in direction 179 as shown in FIGS. 11 and 12.

The operating key 82 travels through the 110° door-unlocking angle to move the drive pin 78 from the locked position to the unlocked position. First, the operating key 82 rotates the throw member 162 through 4° of lost motion within the butterfly-shaped throw member-receiving aperture 154 before the throw member 162 engages and rotates the lost-motion drive member 72. Second, the operating key 82 rotates an additional 91° as the drive pin 78, secured within locking notch 167, moves in direction 187 across the bottom of the triangular drive pin-receiving slot 126 until it engages the drive pin ramp 127 of the triangular drive pin-receiving slot 126. Rotating the drive pin 78 into the drive pin ramp 127 forces the drive pin 78 out of locking notch 167. Third, the operating key 82 rotates another 15° as the drive pin 78 moves out of the locking notch 167, around detent 191, and into longitudinally extending portion 169 as shown in FIG. 12.

At this point, the movement of the drive pin 78 differs, depending on whether the lockset 10 includes a button bar 88. If the lockset 10 includes a button bar 88, the drive pin 78 will not move axially inward until the operating key 82 is further rotated clockwise in direction 179 to rotate the retractor control member 62 and retract the latch bolt 22, thereby disengaging the button bar 88 from the catcher bar 186 and permitting the compression spring 80 to bias the drive pin 78 in direction 189 to its axially inward unlocked position as shown in FIG. 12. If the lockset 10 does not include a button bar 88, the drive pin 78 moves axially inward in direction 189 due to the bias of compression spring 80 immediately after the drive pin 78 is forced out of locking notch 167.

After the drive pin 78 is in its axially inward unlocked position, further key 82 rotation in clockwise direction 179 positions the drive pin 78 in unlocking notch 165 to prevent the further clockwise rotation from moving the drive pin 78 axially outwardly toward the locked position. The operating key 82 rotates through a total door-unlocking angle 197 of 110° to move the locking lug 76 from its locked position to its unlocked position as shown in FIG. 12.

To remove the operating key 82 from the lock core 84 after the lockset 10 has been unlocked, the operating key 82 must be rotated 110° in the counterclockwise direction 181. After the operating key 82 is removed when the lockset 10 is in the unlocked position, the throw member 162 is positioned within the butterfly-shaped throw member-receiving aperture 154 so that there is 0° clearance between the throw member 162 and the lost-motion drive member 72 in the counterclockwise direction 181 and 95° clearance between the throw member 162 and the lost-motion drive member 72 in the clockwise direction 179.

The drive pin-receiving slot 158 of the lost-motion drive member 72 can be formed in various shapes to perform different locking and unlocking functions. The drive pin-receiving slot 158 shown in FIGS. 2, 2*a*, and 8–12 is formed to permit operating key 82 rotation to move the locking lug 76 axially between its locked position and unlocked position.

Figure 13:
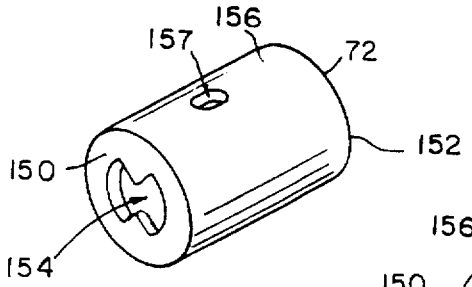
FIG. 13 is an enlarged perspective view of one alternative embodiment of the lost-motion drive member showing a drive pin-receiving slot that prohibits the drive pin from moving axially.
Figure 14:
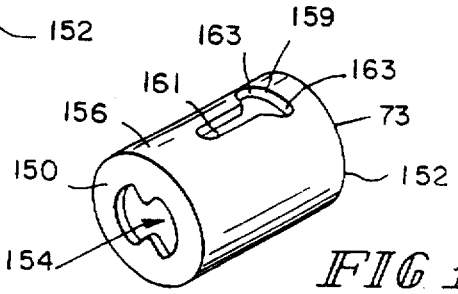
FIG. 14 is an enlarged perspective view of another alternative embodiment of the lost-motion drive member showing a T-shaped drive pin-receiving slot.

Alternative embodiments of the lost-motion drive member 72 are shown in FIGS. 13 and 14. The drive pin-receiving slot 157 formed in the lost-motion drive member 72 shown in FIG. 13 does not permit the drive pin 78 to move axially inward or outward. The drive pin 78 is always positioned axially outward away from the door 12 in the locked position because it cannot be moved axially inward to the unlocked position.

The drive pin-receiving slot 159 formed in the lost-motion drive member 72 shown in FIG. 14 permits the drive pin 78 to move in an axially outward direction from the unlocked position to the locked position, but only in response to movement by the push button 86 and button bar 88. Use of an operating key 82 or push button 86 can move the drive pin 78 from its axially outward locked position to its axially inward unlocked position, but the operating key 82 cannot be used to move the drive pin 78 from its axially inward unlocked position to its axially outward locked position.

The drive pin-receiving slot 159 shown in FIG. 14 is T-shaped and includes a straight portion 161 extending parallel to the axis of rotation 29 and notches 163 on both sides of the straight portion 161 at its axially inner end. The operating key 82 cannot be used to move the drive pin 78 from its axially inward unlocked position to its axially outward locked position because when the lost-motion drive member 72 rotates in response to rotation of operating key 82, it traps the drive pin 78 in one of the notches 163 preventing the drive pin 78 from moving axially. Basically, the notches 163 perform the same function as unlocking notch 165 in the drive pin-receiving slot 158. To unlock the door 12 in response to rotation of operating key 82, the lost-motion drive member 72 rotates the drive pin 78 into the retractor control member 62. This causes the retractor control member 62 to rotate and thus the rollback cams 13 operate the latch bolt retractor assembly 18 to retract the latch bolt 22. The operation of the latch bolt retractor assembly 18 releases the button bar 88 from the catcher bar 186 and the compression spring 80 biases the locking-control bushing 74 and locking lug 76 axially inward to the unlocked position.

The locking-unlocking assembly has at least 93° lost-motion driving connection built in to permit the 93° latch bolt retraction-delay driving connection between the lever arm 70 and the latch bolt 22 to be successful. When the lockset 10 is overtorqued and the locking lug 76 shears, the lever arm 70 is free to rotate. The lever arm 70 rotation causes the throw member 162 to rotate and thereby the throw member 162 begins to operate the locking-unlocking assembly 58. The lost-motion driving connection built into the locking-unlocking assembly 58 permits the throw member 162 to rotate at least 93° with the lever arm 70 before the locking lug 76 moves toward its unlocked door position or the drive pin 78 rotates the retractor control member 62. The lost-motion driving connection in the locking-unlocking assembly 58 keeps the locking lug 76 in its locked position even during an overtorque attack. It is important to keep the locking lug 76 in its locked position because if it moves toward the unlocked position it may enter the axially extending locking lug-receiving slot 132 and rotate the retractor control member 62 which causes the latch bolt 22 to retract and permits the door 12 to open.

Because the drive pin 78 is fixed to the locking-control bushing 74, the locking-control bushing 74 is constrained to move axially outwardly and circumferentially as the drive pin 78 moves axially outwardly and circumferentially. However, the locking lug 76 only moves axially outward in direction 183, shown in FIG. 10, relative to the door 12 because it is circumferentially fixed within the axial locking lug slot 112 of the outer spindle 60 and is rotatable relative to the locking-control bushing 74. This axial outward movement of the locking lug 76 moves the locking lug 76 to its locked position as shown in FIGS. 15–18.

In the locked position, the locking lug 76 engages the axially extending locking lug-receiving slot 48 formed in the outer hub 32 and the axially extending locking lug-receiving slot 112 formed in the outer spindle 60 as shown in FIGS. 15–18. Because the outer hub 32 is fixed relative to the door 12 (i.e., not permitted to rotate), the locking lug 76 is also fixed and prevents the outer spindle 60 and lever arm 70, that is directly coupled to the outer spindle 60, from rotating as shown in FIG. 16. In this locked position, there is no direct-torque-drive connection between the lever arm 70 and the roll back cams 13 on the retractor control member 62 and thus the latch bolt retractor assembly 18 cannot be operated to retract the latch bolt 22. In fact, in the locked position the locking lug 76 does not even contact the drive surface 133 of the retractor control member 62 because the locking lug 76 now lies in the same plane as the circumferentially extending slot 134 formed in the retractor control member 62. This prevents the retractor control member 62 from rotating when the lever arm 70 is "yanked", because in the locked position, the retractor control member 62 is not in a direct torque-drive connection with the lever arm 70.

Figure 19:
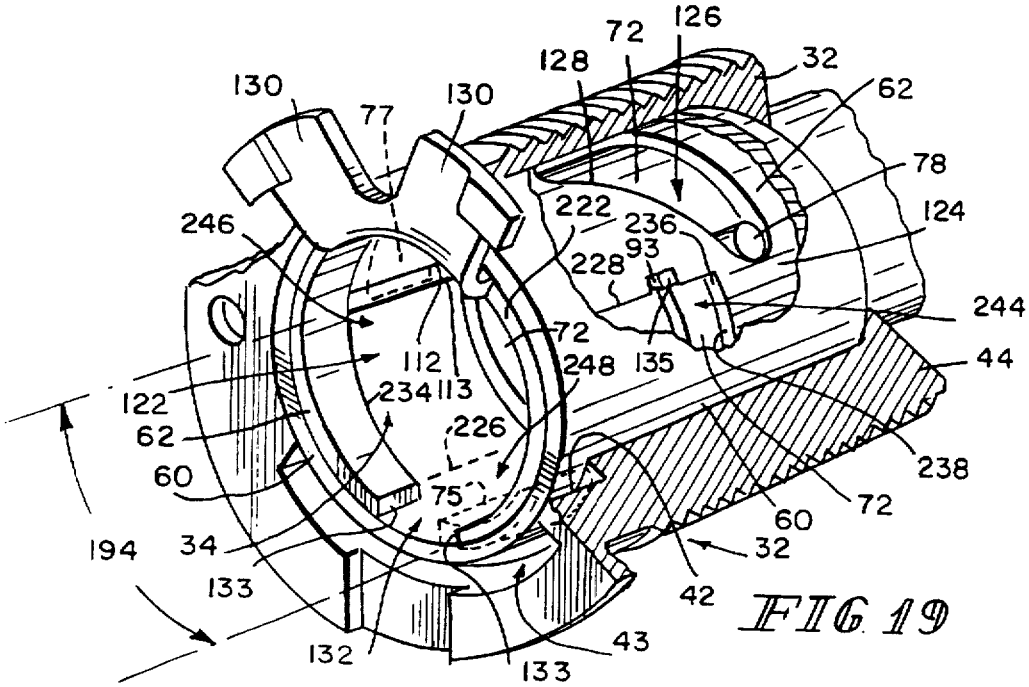
FIG. 19 is a view corresponding to FIG. 18 (after the threaded outer hub has been rotated 90° in a clockwise direction about a central axis of the cylindrical lockset), showing an attached portion of the sheared locking lug (in phantom), a broken portion of the sheared locking lug (in phantom), and the outer spindle after they have been rotated through the 93° latch bolt retraction-delay angle without rotating the retractor control member relative to the outer hub.

Someone attempting to gain unauthorized access through the door 12 may place a large force 190 on the lever arm 70 to produce a large torque on the locking lug 76, as shown in FIG. 18. The locking lug 76 includes V-shaped shear notches 192 to provide a controlled shear line if the locking lug 76 is overtorqued as shown in FIGS. 18–19.

In the illustrated embodiment of the present invention, the V-shaped shear notches 192 are positioned on the axially inner and axially outer sides of the locking lug 76 to create a reduced cross-sectional frangible area. However, in alternative embodiments any number of notches or cavities may be present on any side of the locking lug to create a reduced cross-sectional area.

In the event the locking lug 76 shears, the V-shaped shear notches 192 create a controlled shear line through the reduced cross-sectional area. The locking lug 76 shears at a position above the inner circumference of the outer hub 32 as shown in FIG. 18. Shearing along the controlled shear line permits the attached portion 77 of the locking lug 76 to rotate without engaging the outer hub 32. The "broken off" piece 75 of the locking lug 76 remains in the axial locking lug-receiving slot 48 of the outer hub 32 to prevent it from engaging the outer spindle 60 permitting the outer spindle 60 to rotate relative to the outer hub 32.

If the locking lug 76 shears, the lever arm 70 will rotate through a latch bolt retraction-delay angle 194 of approximately 93° without rotating the retractor control member 62. The latch bolt retraction-delay angle 194 is present because as the lever arm 70 rotates, the attached portion 77 of the locking lug 76 travels through the annular, circumferentially extending locking lug-receiving slot 134 formed in the retractor control member 62 without engaging and rotating the retractor control member 62 and thus without retracting the latch bolt 22. The latch bolt 22 does not retract because even though the lever arm 70, outer spindle 60, and attached portion 77 of the locking lug 76 are rotating, the attached portion 77 of the locking lug 76 has not established a direct-torque-drive connection with the retractor control member 62 as shown in FIG. 18. As can be seen in FIG. 19 as opposed to FIG. 17, the outer spindle 60 and the attached portion 77 of the locking lug 76 (shown in phantom) have rotated through the 93° latch bolt retraction-delay angle 194 without the retractor control member 62 rotating.

Figure 21:
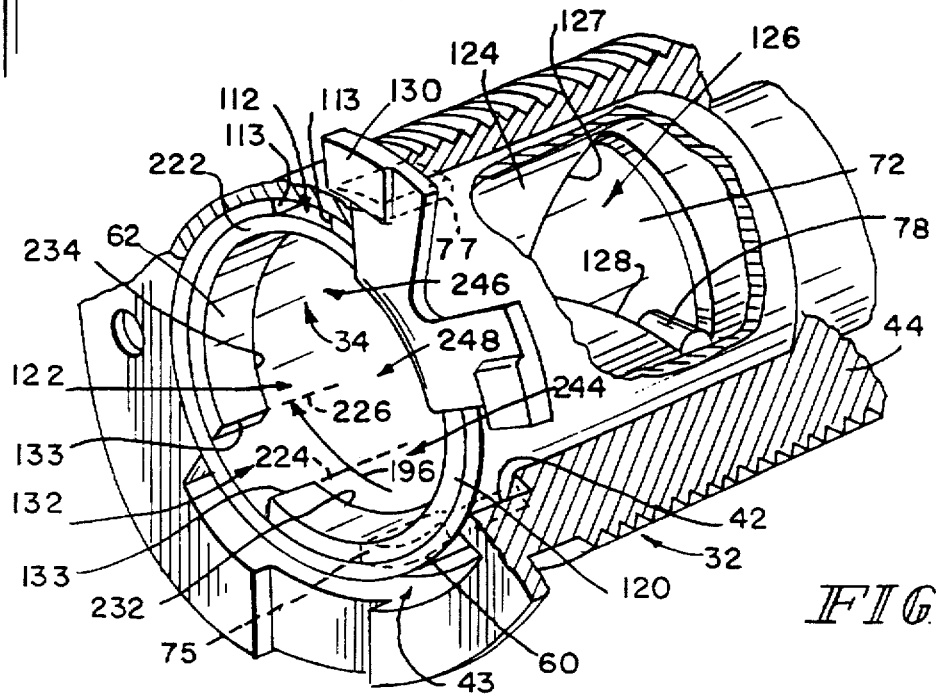
FIG. 21 is a view corresponding to FIG. 20 (after the threaded outer hub has been rotated 90° in a clockwise direction about a central axis of the cylindrical lockset), showing the position of the retractor control member and outer spindle when the lever handle engages the door frame.

After the lever arm 70 is rotated 93°, the attached portion 77 of the locking lug 76 will establish a direct-torque-drive connection with and rotate the retractor control member 62 as shown in FIGS. 20–21. However, the latch bolt 22 will not completely retract because the lever arm 70 will contact the door frame 24, preventing further rotation of the lever arm 70, before the latch bolt 22 is completely retracted from the door frame 24. This provides a more secure condition if the locking lug 76 is overtorqued and sheared during an attack on lockset 10.

While the lever arm 70 is rotating after the locking lug 76 shears, the throw member 162 rotates just as if the operating key 82 was rotating. As discussed earlier, the lost-motion driving connection in the locking-unlocking assembly allows the attached portion 77 of the locking lug 76 to rotate through the 93° latch bolt retraction-delay angle 194 before rotating the retractor control member 62 to retract the latch bolt 22.

After the lever arm 70 has rotated approximately 93°, the attached portion 77 of the locking lug 76 engages the retractor control member 62 and further rotation of the lever arm 70 begins retracting the latch bolt 22 as shown in FIGS. 20–21. After approximately 270 further rotation through angle 196, the lever arm 70 contacts the door frame 24 preventing further rotation of the lever arm 70. Generally, it requires 60° of lever arm 70 rotation to retract the latch bolt 22 completely. Therefore, the latch bolt 22 will only be approximately 55% of the way out of the door frame 24 when the door frame 24 stops rotation of the lever arm 70. The latch bolt retraction-delay angle between the outer spindle 60 and the retractor control member 62 when the lockset 10 is in the locked position results in the lever arm 70 rotating through an angle 198 of approximately 120° with the retractor control member 62 only being rotated through an angle 196 of approximately 27°.

In preferred embodiments of the present invention, the outer door handle 14 includes the lever arm 70 and a return 71 as shown in FIG. 20. The return 71 is the portion of the outer door handle 14 that engages the door frame 24. In alternative embodiments of the present invention, the outer door handle may be formed to only include a lever arm which does not permit the outer door handle to engage the door frame.

The door handle return assembly 56 is also affected when a person shears the locking lug 76. After the first 60° of rotation by the lever arm 70 through angle 198, one of the spring lugs 142, 143 of the spring drive plate 64 engages one of the spring lug travel-limiting faces 52 formed in the outer hub 32. The spring drive plate 64 is configured to "stretch and deform" and permit the key 140 of the spring drive plate 64 to disengage the outer spindle 60. The "stretching and deforming" helps to prevent the outer spindle 60 and retractor control member 62 from coupling which would permit the outer spindle 60 to rotate the retractor control member 62 before the outer spindle had rotated through the 93° latch bolt retraction-delay angle 194. The ability of the spring drive plate 64 to "stretch and deform" further ensures a more secure condition will be achieved in the event a person overtorques the lockset 10.

The locking lug 76 provides three functions: (1) it drives the retractor control member 62 when the lockset 10 is in an unlocked position, (2) it provides means for locking the lever arm 70, and (3) it provides a positive stop to prevent damage to weaker components in the lockset 10. In the unlocked position, the locking lug 76 is the main link between the outer spindle 60 which is driven by the lever arm 70 and the retractor control member 62 which drives the latch bolt retractor assembly 18 to retract the latch bolt 22. In essence, the locking lug 76 acts as a key between the retractor control member 62 and the outer spindle 60. The locking lug 76 couples the retractor control member 62 and outer spindle 60 in the unlocked position and uncouples the retractor control member 62 and outer spindle 60 in the locked position.

In the locked position, the locking lug 76 is situated in the axially extending locking lug-receiving slot 48 of the outer hub 32. This creates a locked condition between the outer hub 32 and the outer spindle 60 to prevent the lever arm 70 from rotating. If the locking lug 76 is overtorqued and sheared, it will rotate through a 93° latch bolt retraction-delay angle 194 in the annular slot 134 in the retractor control member 62 before establishing direct-torque-drive connection with the retractor control member 62.

Although the invention has been described in detail with reference to certain preferred embodiments, variations and modifications exist within the scope and spirit of the invention as described and as defined in the following claims.

We claim:

1. A cylindrical lock for use in a door containing a latch bolt supported for movement between an extended door-latching position and a retracted door-unlatching position and a latch bolt retractor assembly connected to the latch bolt and movable relative to the door to move the latch bolt between the extended door-latching position and the retracted door-unlatching position, the cylindrical lock comprising a hub adapted to mount in a fixed position on the door, the hub including an inner end adapted to lie adjacent to the latch bolt retractor assembly, an outer end adapted to face away from the latch bolt retractor assembly, a central hub aperture extending between the inner and outer ends, an axially extending hub slot, and a circumferentially extending hub slot, a spindle mounted for rotational movement about an axis of rotation within the central hub aperture, the spindle including an inner end adapted to face toward the latch bolt retractor assembly, an outer end adapted to face away from the latch bolt retractor assembly, and a central spindle aperture extending between the inner and outer ends, a door handle coupled to the spindle to rotate the spindle about the axis of rotation relative to the hub, a retractor control member mounted for rotational movement within the central spindle aperture about the axis of rotation, the retractor control member including an inner end facing away from the door handle, an outer end adapted to face away from the latch bolt retractor assembly, and a cam adapted to engage the latch bolt retractor assembly to move the latch bolt between the extended door-latching position and the retracted door-unlatching position in response to rotation of the retractor control member about the axis of rotation, a locking lug mounted for movement within the retractor control member between an axially outer locked position wherein the locking lug is situated in the axially extending hub slot to prevent rotation of the spindle relative to the hub and an axially inner unlocked position toward the door relative to the axially outer locked position wherein the locking lug is situated in the circumferentially extending hub slot to permit the spindle to rotate relative to the hub, and means for moving the locking lug between the unlocked position coupling the spindle and retractor control member together so that the retractor control member rotates about the axis of rotation to move the latch bolt retractor assembly to move the latch bolt from the extended door-latching position to the retracted door-unlatching position in response to rotation of the spindle about the axis of rotation by the door handle and the locked position uncoupling the spindle and retractor control member so that the retractor control member does not rotate about the axis of rotation and the latch bolt retractor assembly is not moved to move the latch bolt from the extended door-latching position to the retracted door-unlatching position in response to the rotation of the spindle about the axis of rotation, the retractor control member being formed to include a circumferentially extending retractor control member slot, the locking lug being situated within the circumferentially extending retractor control member slot in the locked position, wherein the locking lug is formed to include notches providing a planned shear line through which the locking lug will shear if overtorqued, and the circumferentially extending retractor control member slot is configured to permit a sheared locking lug to rotate through a certain latch bolt retraction-delay angle before engaging and rotating the retractor control member.

2. A cylindrical lock for use in a door containing a latch bolt supported for movement between an extended door-latching position and a retracted door-unlatching position and a latch bolt retractor assembly connected to the latch bolt and movable relative to the door to move the latch bolt between the extended door-latching position and the retracted door-unlatching position, the cylindrical lock comprising a hub adapted to mount in a fixed position on the door, the hub including an inner end adapted to lie adjacent to the latch bolt retractor assembly, an outer end adapted to face away from the latch bolt retractor assembly, and a central hub aperture extending between the inner and outer ends, a spindle mounted for rotational movement about an axis of rotation within the central hub aperture, the spindle including an inner end adapted to face toward the latch bolt retractor assembly, an outer end adapted to face away from the latch bolt retractor assembly, and a central spindle aperture extending between the inner and outer ends, a door handle coupled to the spindle to rotate the spindle about the axis of rotation relative to the hub, a retractor control member mounted for rotational movement within the central spindle aperture about the axis of rotation, the retractor control member including an inner end adapted to face toward the latch bolt retractor assembly, an outer end adapted to face away from the latch bolt retractor assembly, and a cam adapted to engage the latch bolt retractor assembly to move the latch bolt between the extended door-latching position and the retracted door-unlatching position in response to rotation of the retractor control member about the axis of rotation, a locking lug configured to lock the spindle against rotation relative to the hub, the locking lug including a frangible section, and delayed actuation means for providing a latch bolt retraction-delay angle between the door handle and latch bolt retractor assembly when the locking lug is in a locked position so that when the cylindrical lock is subject to excessive torque about the axis of rotation, causing the frangible section of the locking lug to shear, the door handle and spindle rotate about the axis of rotation through the latch bolt retraction-delay angle before rotating the retractor control member to delay the cam of the retractor control member from driving the latch bolt retractor assembly and moving the latch bolt from the extended door-latching position to the retracted door-unlatching position.

3. The cylindrical lock in claim 2, wherein the retractor control member is formed to include a circumferentially extending retractor control member slot about the axis of rotation through which the locking lug travels after it shears.

4. The cylindrical lock of claim 3, wherein the locking lug rotates about the axis of rotation through approximately a 93° latch bolt retraction-delay angle in the circumferentially extending retractor control member slot before engaging and rotating the retractor control member.

5. The cylindrical lock of claim 3, wherein the spindle includes an axially extending spindle slot in the direction of the axis of rotation at the inner end and the retractor control member is formed to include an axially extending retractor control member slot in communication with the circumferentially extending retractor control member slot and the axially extending spindle slot.

6. The cylindrical lock of claim 5, wherein the axially extending spindle slot and the axially extending retractor control member slot define a channel through which the locking lug travels between the locked position and an unlocked position.

7. The cylindrical lock of claim 3, wherein the locking lug, spindle, and door handle rotate about the axis of rotation through the latch bolt retraction-delay angle while the retractor control member remains stationary when a sheared locking lug travels through the circumferentially extending retractor control member slot.

8. The cylindrical lock of claim 2, wherein after the door handle rotates about the axis of rotation through the latch bolt retraction-delay angle, a remaining portion of the sheared locking lug engages the retractor control member and further rotation of the door handle about the axis of rotation rotates the retractor control member about the axis of rotation relative to the hub.

9. The cylindrical lock of claim 8, wherein the door handle is configured to engage a door frame situated adjacent to the door and housing the latch bolt in the extended door-latching position, preventing further rotation of the door handle about the axis of rotation, before the retractor control member completely retracts the latch bolt to prevent the latch bolt from moving a full distance from the extended door-latching position to the retracted door-unlatching position.

10. The cylindrical lock of claim 9, wherein the latch bolt retracts approximately 55% of the distance between the extended door-latching position and the retracted door-unlatching position before the door handle engages the door frame.

11. A cylindrical lock for use in a door containing a latch bolt supported for movement between an extended door-latching position and a retracted door-unlatching position and a latch bolt retractor assembly connected to the latch bolt and movable relative to the door to move the latch bolt between the extended door-latching position and the retracted door-unlatching position, the cylindrical lock comprising a hub adapted to mount in a fixed position on a door, the hub being formed to include a first hub slot and a second hub slot communicating with the first hub slot, a door handle mounted for rotation relative the hub, a spindle coupled to the door handle and being formed to include a spindle slot defined by spaced-apart driving surfaces, a retractor control member formed to include a first retractor control member slot and a second retractor control member slot communicating with the first retractor control member slot, and a locking lug movable between a first position fixing the spindle and hub together and a second position uncoupling the spindle and hub, in the first position the locking lug is positioned to lie in the first hub slot formed in the hub and the spindle slot formed in the spindle and in the second position the locking lug is positioned to lie in the spindle slot formed in the spindle and the second hub slot formed in the hub, and the locking lug being formed to include a frangible section through which the locking lug shears if overtorqued when in the first position.

12. The cylindrical lock of claim 11, wherein the second retractor control member slot is a circumferentially extending retractor control member slot configured to permit a sheared locking lug to rotate through a certain latch bolt retraction-delay angle before engaging and rotating the retractor control member.

13. The cylindrical lock of claim 11, wherein the frangible section includes a notch formed in the locking lug.

14. The cylindrical lock of claim 13, wherein the notch defines a planned shear line.

* * * * *

UNITED STATES PATENT AND TRADEMARK OFFICE

CERTIFICATE OF CORRECTION

PATENT NO. : 5,794,472

DATED : August 18, 1998

INVENTOR(S) : Kester et al.

It is certified that error appears in the above-identified patent and that said Letters Patent is hereby corrected as shown below:

On the Title page, item [75] Inventors, "";Ralph P. Palmer,"Indianapolis should be deleted.

Signed and Sealed this

Thirteenth Day of July, 1999

*Attest:*

*Attesting Officer*

Q. TODD DICKINSON

*Acting Commissioner of Patents and Trademarks*